US007420550B2

(12) United States Patent
Yuh-Ren et al.

(10) Patent No.: US 7,420,550 B2
(45) Date of Patent: Sep. 2, 2008

(54) LIQUID CRYSTAL DISPLAY DRIVING DEVICE OF MATRIX STRUCTURE TYPE AND ITS DRIVING METHOD

(75) Inventors: Shen Yuh-Ren, Tainan (TW); Chen Cheng-Jung, Miaoli Hsien (TW); Chen Chun-Chi, Kaohsiung (TW)

(73) Assignee: Vast View Technology, Inc., Hsinchu (TW)

( * ) Notice: Subject to any disclaimer, the term of this patent is extended or adjusted under 35 U.S.C. 154(b) by 677 days.

(21) Appl. No.: 10/929,473

(22) Filed: Aug. 31, 2004

(65) Prior Publication Data

US 2006/0044292 A1 Mar. 2, 2006

(51) Int. Cl.
*G09G 3/36* (2006.01)

(52) U.S. Cl. ..... 345/204; 345/50; 345/90; 345/98; 345/103; 345/214; 349/143

(58) Field of Classification Search ..... 345/50, 345/58, 90, 93, 95, 98, 103, 204, 205, 214; 349/143

See application file for complete search history.

(56) References Cited

U.S. PATENT DOCUMENTS

| | | | | |
|---|---|---|---|---|
| 5,805,128 | A * | 9/1998 | Kim et al. | 345/96 |
| 6,057,904 | A * | 5/2000 | Kim et al. | 349/143 |
| 6,157,056 | A * | 12/2000 | Takeuchi et al. | 257/315 |
| 6,310,594 | B1 * | 10/2001 | Libsch et al. | 345/90 |
| 2004/0056331 | A1 * | 3/2004 | Chen et al. | 257/629 |

* cited by examiner

*Primary Examiner*—Bipin Shalwala
*Assistant Examiner*—Vince E Kovalick
(74) *Attorney, Agent, or Firm*—Lowe Hauptman Ham & Berner, LLP

(57) ABSTRACT

A liquid crystal display driving device of matrix structure type and its driving method are disclosed in the present invention. The driving device consists of a group of thin film transistors with matrix array, a plurality of gate lines and a plurality of data lines. The object of increasing response speed can be accomplished by the different arrangement of gate lines and data lines and the different connection between each thin film transistor and the gate and data lines. The driving method for the said driving device includes: each pair of gate lines in the display panel are simultaneously and orderly turned on at different time of driving transistor, and the different driving voltages are orderly applied to the thin film transistors connected to the gate lines. The structure and method can suit for picture treating of various displays such as liquid crystal display, organic light-emitting diode (OLED) display or plasma display panel (PDP).

7 Claims, 26 Drawing Sheets

LIQUID CRYSTAL DISPLAY DRIVING DEVICE OF MATRIX STRUCTURE TYPE AND ITS DRIVING METHOD

BACKGROUND OF THE INVENTION

1. Field of the Invention

The present invention relates to a liquid crystal display driving device of matrix structure type and its driving method, especially to a display driving device and its driving method, which can simultaneously or synchronously drive a plurality of thin film transistors to increase the response speed, wherein the source and the gate of each thin film transistor in the driving device are respectively connected with different gate lines and data lines to let the specific transistor be driven by the gate drivers and the data drivers, and the predetermined voltage for over drive or the data voltage for the present frame interval is applied to accomplish the object of increasing the response speed. The present invention can suit for the picture treatment of various liquid crystal displays, organic light emitting diode (OLED) display or plasma display panel (PDP).

2. Description of the Prior Art

Because the liquid crystal display possesses the advantages of low power consumption, light of weight, thin thickness, without radiation and flickering, it gradually replaces the traditional cathode ray tube (CRT) display in the display market. The liquid crystal display is chiefly used as the screen of the digital television, the computer or the notebook computer. In particular, the large sized liquid crystal display is widely used in the amusements of the life, especially in the field in which the view angle, the response speed, the color number, and the image of high quality are in great request.

Referring to FIGS. 1A and 1B, they are the simple schematic views showing the internal structure of the prior liquid crystal display. Mark 10 is the display panel. The data driver 11 is installed above the display panel, which can change the data of the adjusted gray level signal into the corresponding data voltage. The image signal can be transferred to the display panel 10 through the plurality of data lines 111 connected with the data driver 11. The gate driver 12 is installed on one side of the display panel 10, which can continuously provide scanning signal. The scanning signal can be transferred to the display panel 10 through the plurality of gate lines 121 connected with the gate driver 12. The data line 111 and the gate line 121 are orthogonally crossed and insulated with each other. The area enclosed in them is a pixel 13. After the image signal is output from the data driver 11, it will get to the source of the thin film transistor $Q_1$ in the pixel 13 through the data line $D_1$, and a control signal is correspondingly output from the gate driver 12, it will get to the gate of the thin film transistor $Q_1$ through the gate line $G_1$. The circuit in the pixel 13 will output the output voltage to drive the liquid crystal molecular corresponding to the pixel 13, and a parallel plate type of capacitor $C_{LC}$ (capacitor of liquid crystal) will be formed by the liquid crystal molecules between the two pieces of glass substrates in the display panel 10. Because the capacitor $C_{LC}$ cannot keep the voltage to the next time of renewing the frame data, so there is a storage capacitor $C_S$ provided for the voltage of the capacitor being able to be kept to the next time of renewing the frame data.

The image treatment of the display is affected by the properties of the liquid crystal molecular such as viscosity, dielectricity and elasticity etc. The brightness in the traditional CRT is displayed by the strike of the electron beam on the screen coated with phosphorescent material, but the brightness display in the liquid crystal display needs time for the liquid crystal molecular to react with the driving voltage, the time is called "response time". Taking the normally white (NW) mode as an example, the response time can be divided to two parts:

(1) The ascending response time: it is the time for the liquid crystal molecular to rotate with the application of the voltage when the brightness of the liquid crystal box in the liquid crystal display changes from 90% to 10%, simply called "$T_r$"; and (2) The descending response time: it is the time for the liquid crystal molecular to restore without the application of the voltage when the brightness of the liquid crystal box changes from 10% to 90%, simply called "$T_f$".

When the display speed of the frame is above 25 frames per second, human will regard the quickly changing frames as the continuous picture. In general above 60 frames per second is the display speed of the screen in the modern family amusements such as DVD films of high quality and electronic games of quick movement, in other words, the time of each frame interval is 1/60 sec=16.67 ms. If the response time of the liquid crystal display is longer than the frame interval time, the phenomena of residue image or skip lattice would happen in the screen so that the quality of the image is badly affected. At present the methods for decreasing the response time of the liquid crystal display have: lowering the viscousity, reducing the gap of the liquid crystal box, increasing the dielectricity and the driving voltage, wherein the methods of lowering the viscosity, reducing the gap of the liquid crystal box and increasing the dielectricity can be executed from the material and the making process of the liquid crystal and the method of increasing the driving voltage can be executed from the driving method of liquid crystal panel. The latter can further improve the response speed of the gray level in no need of largely changing the structure of the display panel. It is called "overdrive" (OD) technique, wherein the increasing voltage can be transferred to the liquid crystal panel through the driver integrated circuit (diver IC) to increase the voltage for rotating the liquid crystal so that the expected brightness of the image data can be quickly obtained and the response time can be reduced due to the quick rotation and restoration of the liquid crystal.

Referring to FIG. 2, the liquid crystal display has different brightness at different driving voltage. If $L_1$ is the expected brightness of the image data and the liquid crystal molecular is driven by the present data voltage $V_1$ to display the brightness, the brightness variation displayed by the driven liquid crystal molecular is shown as curve 21 and the time for obtaining the brightness is $t_0$. An increased driving voltage $V_2$ is provided to reduce the time for obtaining the brightness according to the brightness variation of the display gray level, which has been measured in advance. The brightness variation is shown as curve 22. Therefore, the time for obtaining the expected brightness can be reduced from $t_0$ to $t_0'$; this is the so-called OD technique.

Referring to FIG. 3A to 3C, if the expected brightness of an image in the preceding frame interval I−1 is code 32, and the expected brightness of the said image in the present frame interval I becomes code 120, the brightness variation of the liquid crystal display is shown as curve (a) without making use of OD technique. It is shown that the expected brightness cannot be obtained unless the $I+1^{th}$ frame interval is got. This would produce the problem of residue image. By use of OD technique, the driving voltage is increased to code 200 in the present frame interval I to be able to obtain the expected brightness at the end of the frame interval. Its brightness variation is shown as curve (b). In the driving process of the first gate line $G_1$ and the first data line $D_1$, when the frame interval I begins, a control voltage pulse is given to the first gate line $G_1$ by the gate driver and at the same time a driving voltage code 200 is given to the first data line $D_1$ by the data driver so that the first pixel (not shown) connected with the first gate line and the first data line can change its brightness. If the sequential frame interval still display the brightness of code 120 and the next frame interval I+1 begins, a control voltage pulse is still given to the first gate line and the driving voltage given to the first data line is decreased to code 120 to keep the expected brightness. The present invention makes use of the "overdrive" concept and discloses a novel liquid crystal display driving device of matrix structure type and its driving method to reduce the response time of the liquid crystal display.

SUMMARY OF THE INVENTION

The chief object of the present invention is to provide a liquid crystal display driving device of matrix structure type to increase the response speed of the liquid crystal display and the aspect ratio of the panel and to decrease the number of the data drivers and the data lines.

Another object of the present invention is to provide a driving method for the liquid crystal display of matrix structure type, which can simultaneously or synchronously start the plurality of thin film transistors in the display panel and drive the pixels controlled by the thin film transistors to reduce the response time of the liquid crystal display.

To achieve the above-stated objects of the present invention, the basic structure of the driving device of the present invention includes a group of thin film transistors with matrix array, gate lines connected with the gate drivers and insulated with each other, wherein the gates and the sources of all the thin film transistors are respectively connected with the gate lines and the data lines. The response time of the liquid crystal display can be reduced by the different arrangement design of the gate lines and the data lines and by the different connection location between the gate lines and the gates of the thin film transistors and between the data liens and the sources of the thin film transistors. The gate drivers can be respectively installed on the left side and the right side of the liquid crystal panel and the data drivers can be respectively installed on the upper side and the lower side. The gate driver can be a chip installed on glass or an integrated gate driver circuit installed on glass.

The driving method for the said driving device includes: the period of the predetermined voltage of the over drive received by the thin film transistors connected with the first gate line is set as a over exciting period and the period of the data voltage of the present frame interval received by the thin film transistor connected with the first gate line is set as a brightness keeping period.

When the over exciting period begins, two gate lines in the liquid crystal display are turned on in a time of one synchronous control signal or by the control signals simultaneously produced by the gate drivers. The predetermined voltage is given to the thin film transistors connected with one of the gate lines which are simultaneously or synchronously turned on, the data voltage is given to the thin film transistors connected with the other of the gate lines which are simultaneously or synchronously turned on, and scanning continues in turn.

When the brightness keeping period begins, two gate lines in the liquid crystal display are orderly turned on in a time of one synchronous control signal or by the control signals simultaneously produced by the gate drivers. One of the gate lines is the next gate line of the last gate line given to the said predetermined voltage. The predetermined voltage of over drive is given to the thin film transistors connected with the said gate line, and the data voltage of the present frame interval is given to the thin film transistors connected with the first gate line which is turned on orderly. Scanning continues in turn until the whole liquid crystal display is scanned, and the next frame interval begins.

If the ratio of the number of the gate lines scanned in the over excited period to the number of the total gate lines is P and the period of the frame interval of the liquid crystal display is T, then the duration of the over exciting is PT and the duration of the brightness keeping is (1-P)T. The ratio P can be adjusted according to the characteristic of the display panel.

From the statement stated above, the present invention possesses the characteristic of dividing the space of the gate lines of the display panel into a plurality of regions and the time of the frame interval into a plurality of sub-region times. Each region is orderly scanned in a time of one synchronous control signal. Therefore, the state of "frame in frame" is formed in the space and the time. The method of the present invention can suit for various picture treatments of liquid crystal display, organic light emitting diode (OLED) display or plasma display panel (PDP).

To make the present invention be able to be clearly understood, there are some preferred embodiments and their accompanying draws described in detail as below.

DETAILED DESCRIPTION OF THE PREFERRED EMBODIMENT

Figure 1A:
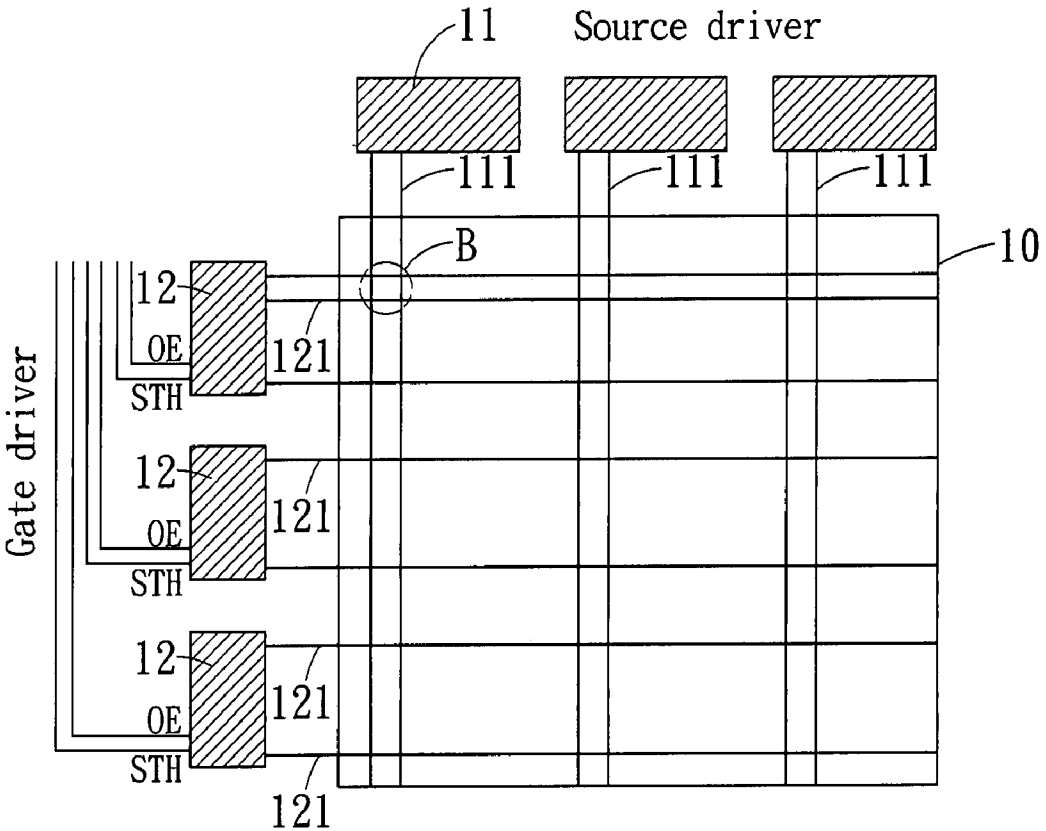
Fig. 1A (Prior Art)
FIG. 1A is a simple schematic view of the structure of the general liquid crystal display.
Figure 1B:
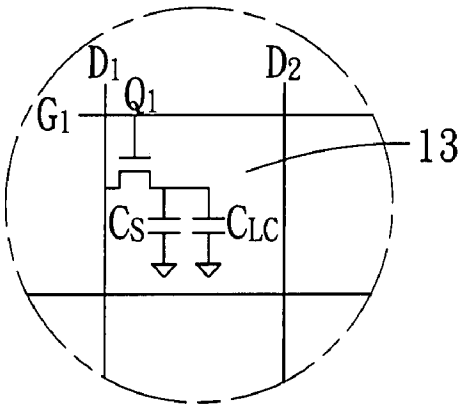
Fig. 1B (Prior Art)
FIG. 1B is an enlarged schematic sectional view taken from FIG. 1A, which shows the arrangement of the elements in the area enveloped in the data lines and the gate lines.
Figure 2:
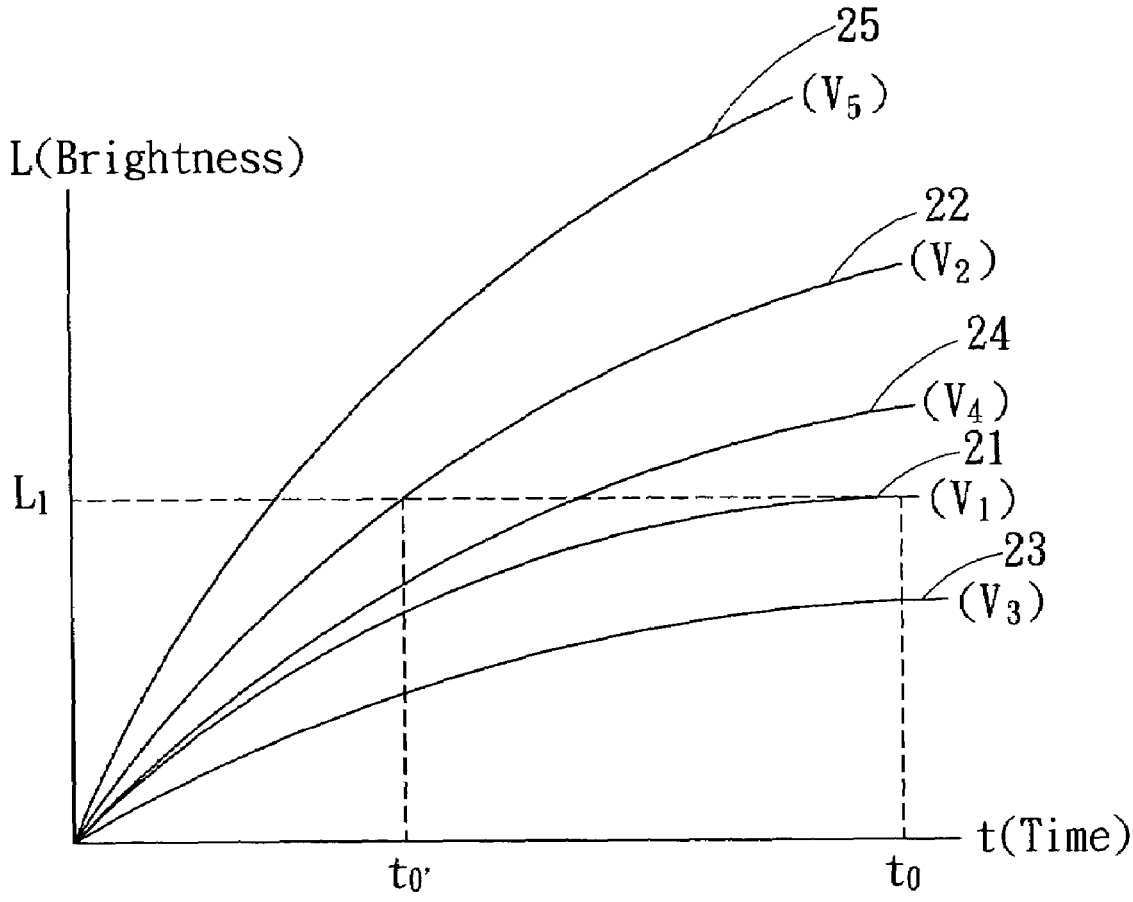
Fig. 2 (Prior Art)
FIG. 2 is a curve view showing the variation of the image brightness of the liquid crystal display with the time at different driving voltages.
Figure 3A:
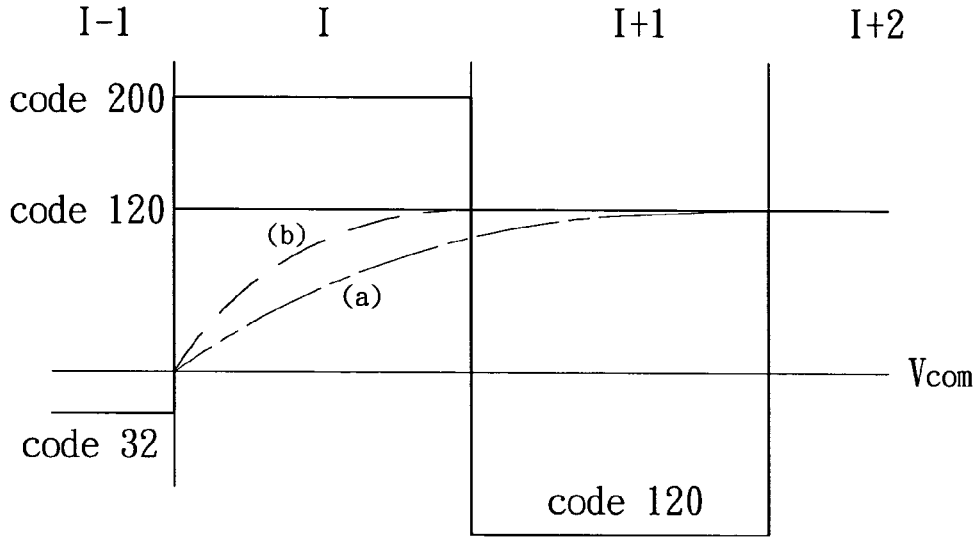
Fig. 3A (Prior Art)
FIG. 3A is a comparison view showing the variation of the expected brightness of a pixel with OD technique and without OD technique.
Figure 3B:
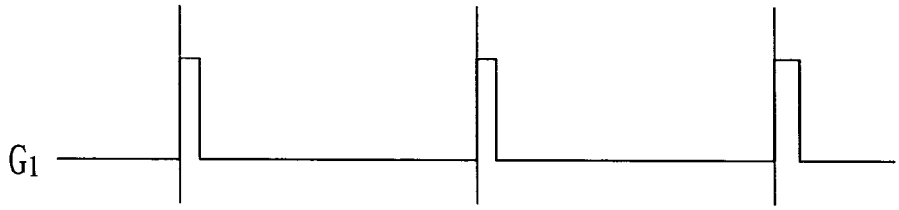
Fig. 3B (Prior Art)
FIG. 3B is a schematic view showing the control voltage pulse of the first gate line from the gate driver of the liquid crystal display in the frame interval of FIG. 3A.
Figure 3C:
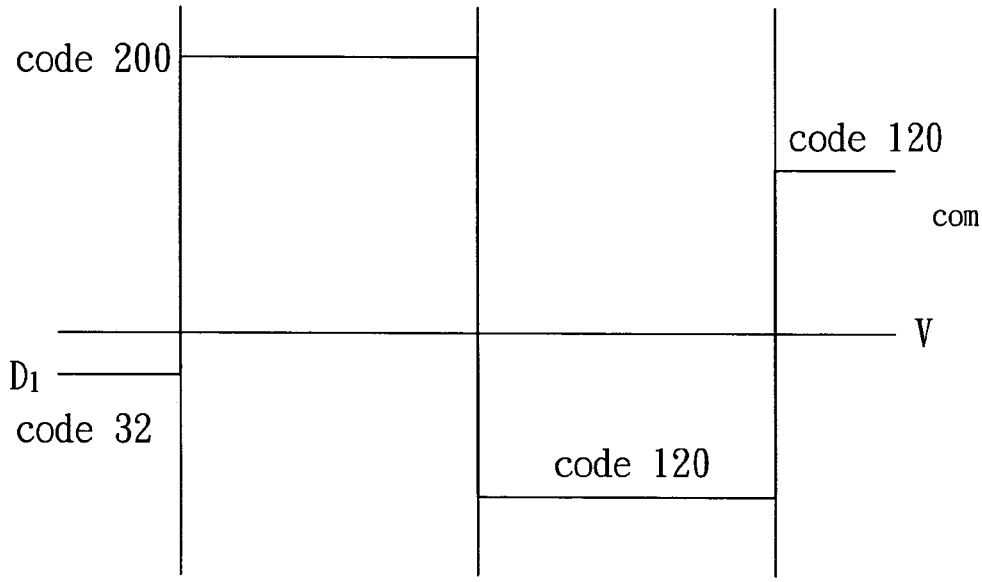
Fig. 3C (Prior Art)
FIG. 3C is a schematic view showing the driving voltage of the first data line from the data drivers of the liquid crystal display in the frame interval of FIG. 3A.

Referring to FIG. 2, because each liquid crystal display panel has its characteristic and each of brightness of the liquid crystal display panel is produced by a preset driving voltage, it is necessary for the OD driving technique that the brightness variation of the panel at various driving voltages would be measured in advance. On the curve in the FIG. 2, the brightness, which is marked 21, 22, 23, 24, and 25, is respectively produced by the voltage $V_1$, $V_2$, $V_3$, $V_4$, and $V_5$. If need be, the number of the curves about the measured brightness can be increased. The variation data of the curve can be made into a lookup table, which can be stored in the electronic elements of the liquid crystal display and become the base on which the driver can select the voltage to produce the brightness of the panel. The means about this technique can be arbitrarily modified and varied by the persons skilled at this art.

The First Embodiment

Figure 4A:
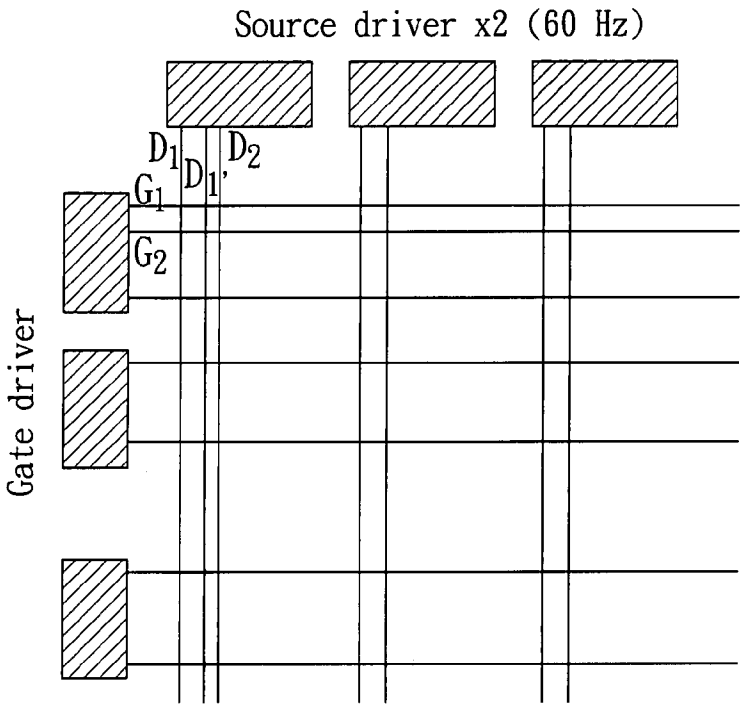
FIG. 4A is a schematic view showing the arrangement of the gate lines and the data lines of the display panel of the first embodiment according to the present invention.
Figure 4B:
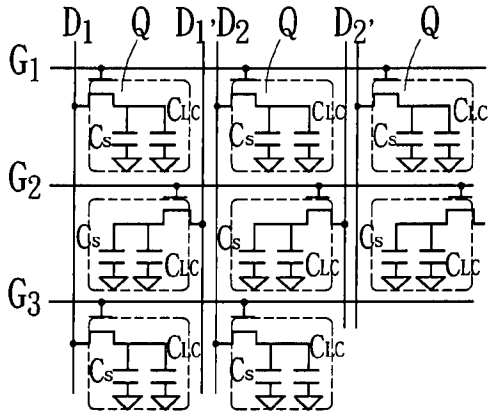
FIG. 4B is an enlarged schematic sectional view taken from FIG. 4A, which shows the arrangement of the gate lines and the data lines and the state of the gate and the source, which are connected to the gate lines and the data lines, of each thin film transistor.
Figure 4C:
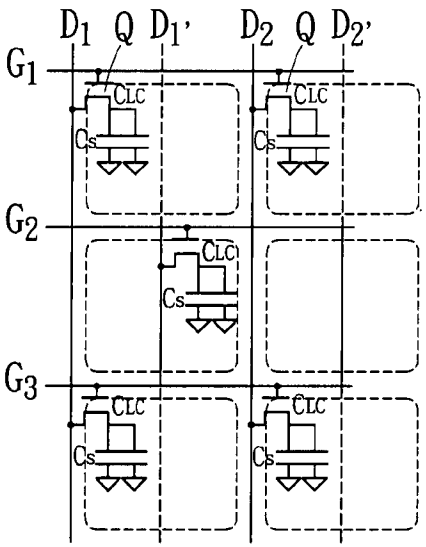
FIG. 4C is an enlarged schematic sectional view taken from FIG. 4A, which shows there is a space between the neighboring data lines for preventing them from short circuit.

Referring to FIG. 4A to 4C, they show a preferred embodiment of the liquid crystal display driving device of matrix structure type according to the present invention. The driving device includes a group of thin film transistors Q with matrix array, which consists of N rows and M columns of thin film transistors, wherein, each thin film transistor Q can drive one pixel, so N×M pixels (shown by rectangle with dotted line) can be driven. The first gate line $G_1$ is connected with the gates of all the thin film transistors Q of the first row, the second gate line $G_2$ is connected with the gates of all the thin film transistors Q of the second row, and so are the others. Therefore, there are N gate lines connected to gate driver and they are insulated with each other.

The first and the second data lines $D_1$, $D_{1'}$ of the first group of data lines are respectively connected with the sources of all the thin film transistors Q of the odd and the even rows of the first column. The first and the second data lines $D_2$, $D_{2'}$ of the second group of data lines are respectively connected with the sources of all the thin film transistors Q of the odd and the even rows of the second column and so are the others. Therefore, in total there are M groups of data lines connected to the data drivers and they are insulated with each other. To prevent the neighboring data lines from short circuit, for example, the second data line $D_{1'}$ of the first group of data lines and the first data line $D_2$ of the second group of data lines, a space is given between the neighboring data lines, of which arrangement is shown as FIG. 4C.

Figure 5A:
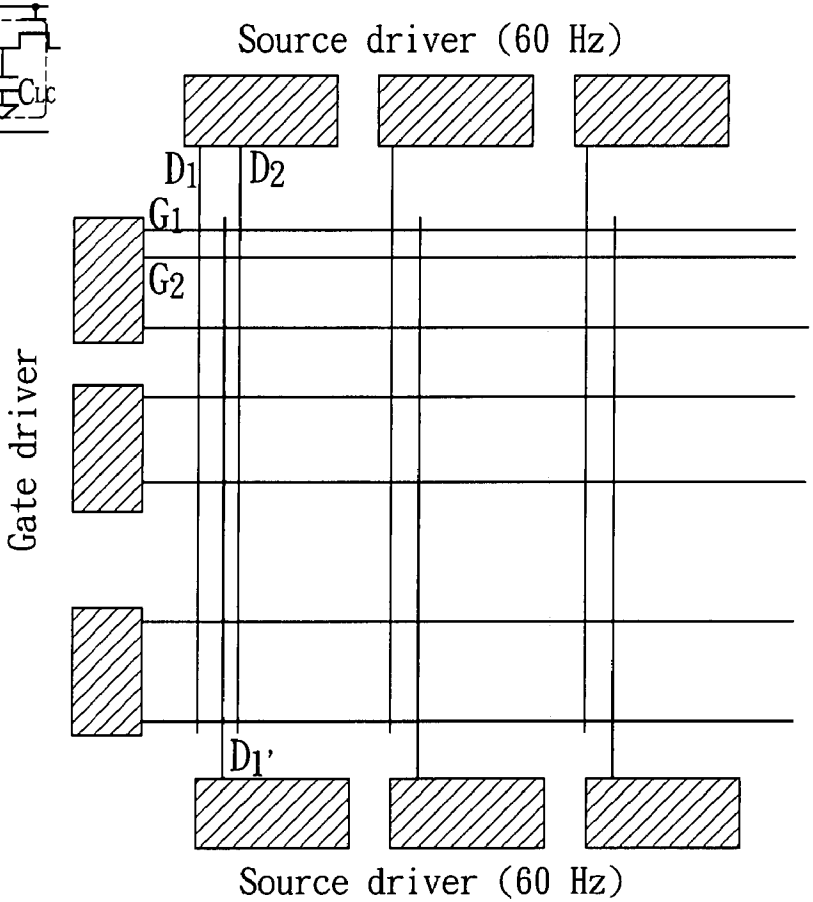
FIG. 5A is a schematic view of the arrangement of the gate lines and the data lines of the display panel of the first embodiment according to the present invention, which shows the state of the data drivers respectively installed on the upper side and the lower side of the display panel.
Figure 5B:
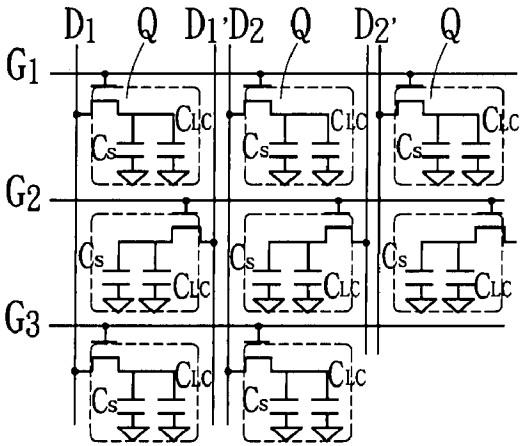
FIG. 5B is an enlarged schematic sectional view taken from FIG. 5A, which shows the arrangement of the gate lines and the data lines and the state of the gate and the source, which are connected to the gate lines and the data lines, of each thin film transistor.
Figure 6A:
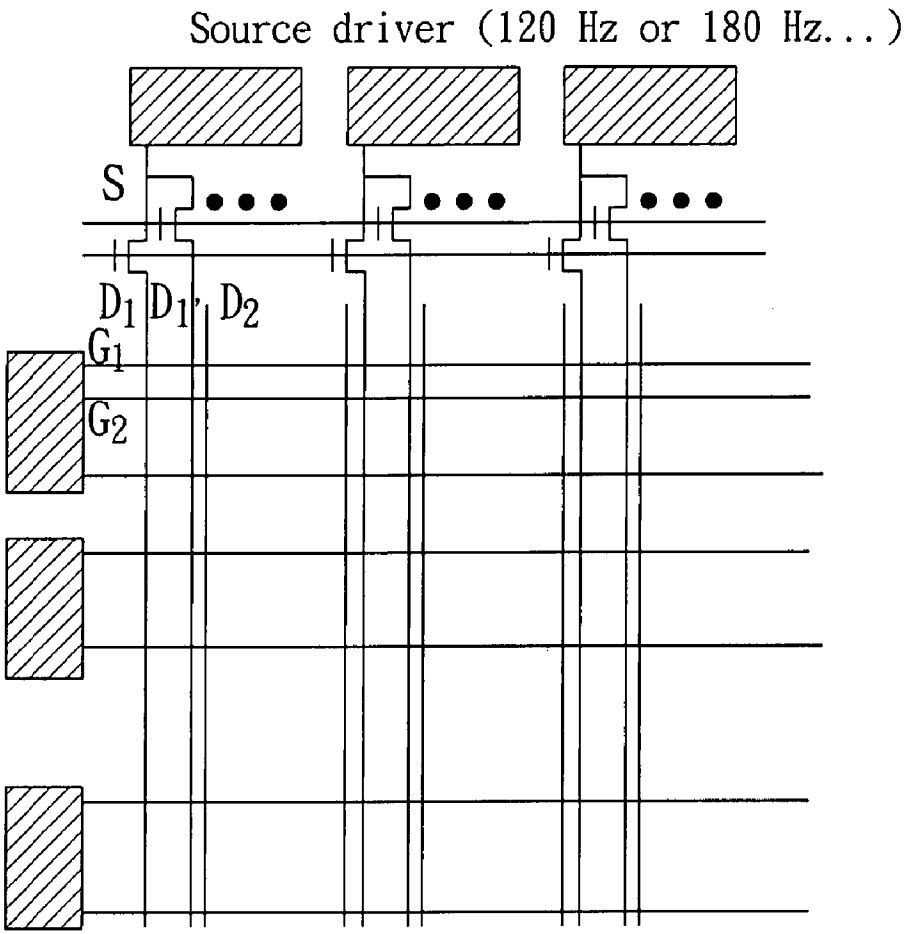
FIG. 6A is a schematic view of the arrangement of the gate lines and the data lines of the display panel of the first embodiment according to the present invention, which shows the state of each pair of data lines connected to a data driver, which is connected to the electronic switch.
Figure 6B:
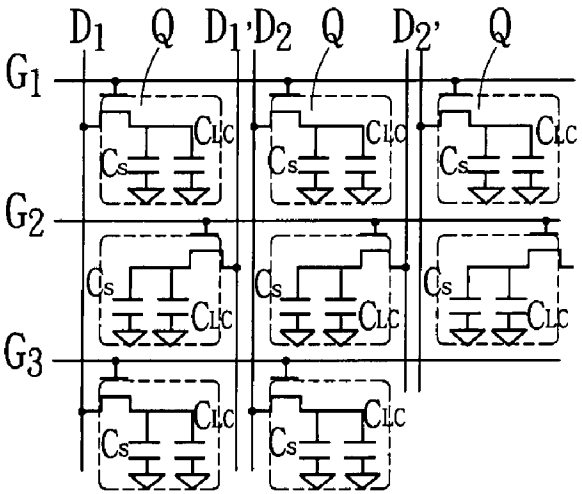
FIG. 6B is an enlarged schematic sectional view taken from FIG. 6A, which shows the arrangement of the gate lines and the data lines and the state of the gate and the source, which are connected to the gate lines and the data lines, of each thin film transistor.

As shown in FIG. 4A, the data drivers connected with the data lines are installed on the same side of the display panel. If the scanning frequency is 60 Hz and there are two gate lines being turned on at the same time, the scanning time can be further decreased. Referring to FIGS. 5A and 5B, the data drivers are respectively arranged on the upper and the lower sides of the liquid crystal display, and the first and the second data line of each group of data lines are respectively connected with the data drivers of the upper and the lower sides of the liquid crystal display, wherein, the scanning frequency of the data drivers is kept at 60 Hz. Referring to FIGS. 6A and 6B, the first data line of each group of data lines and the neighboring second line of another group of data lines are connected with the same data drivers, and the data transfer is switched by an electronic switch S of which scanning frequency is a multiple of 60 Hz, such as 120 Hz, 180 Hz . . . etc. The form of the gate driver can be a chip on glass or an integrated gate driver circuit on glass.

Figure 7:
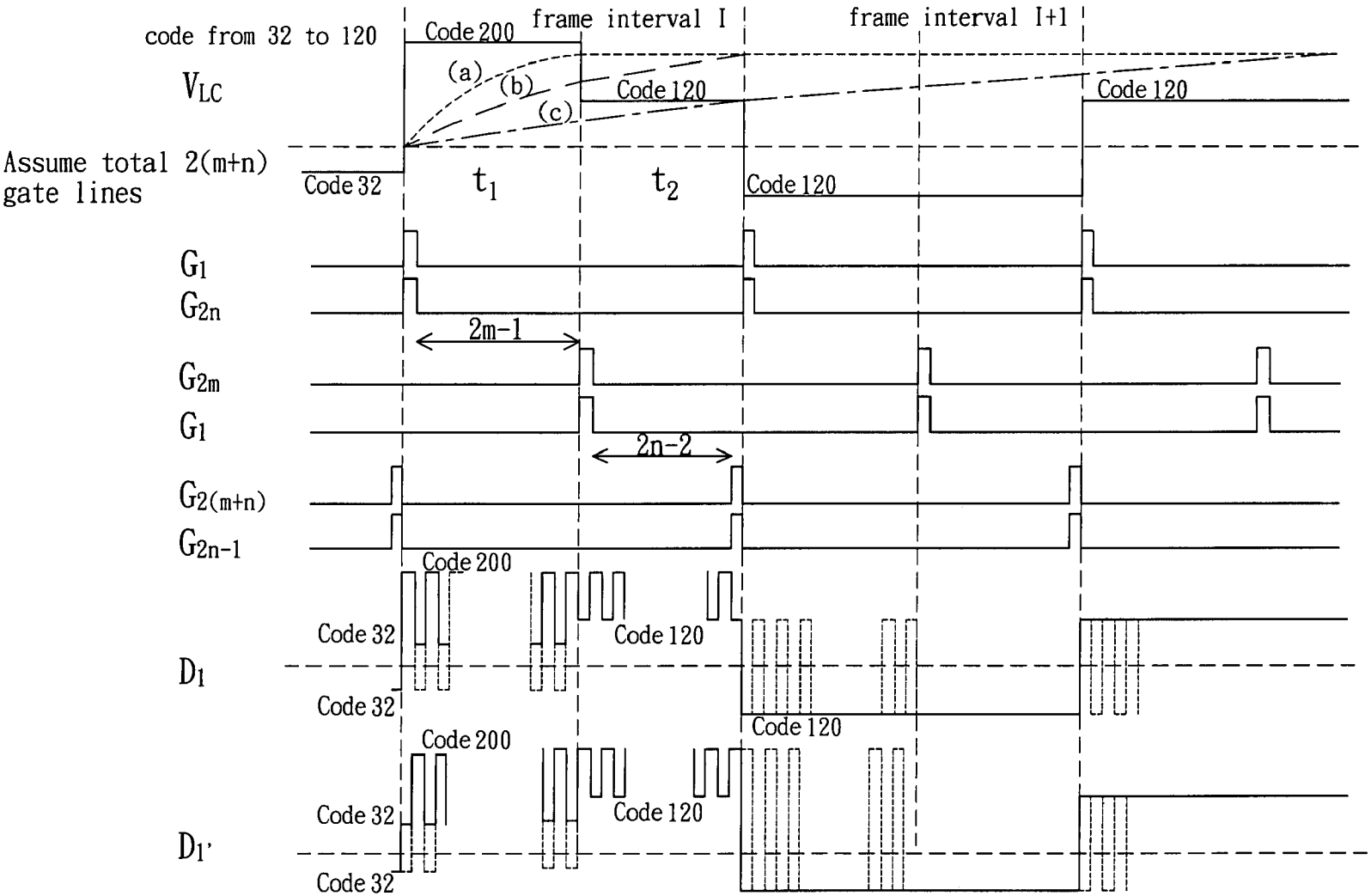
FIG. 7 is a wave form view of the signal used in the driving method of the display device of the first embodiment according to the present invention, which shows the variation of the wave form of the signal of the gate lines and the data lines from the gate driver and the data drive at different frame interval time.

Referring to FIG. 7, in the driving method of the present invention executed by the said device, when time is at frame interval 1, the expected brightness is code 120 and $V_{LC}$ is the driving voltage pulse, the voltage wave form has positive and negative phases due to the driving voltage of the liquid crystal being alternating current. The voltage value will be expressed with code in the following statement. In FIG. 7, curve (a) represents the brightness variation of the pixel in response to 5 milliseconds of over drive, curve (b) shows the brightness variation of the pixel in response to 16 milliseconds of over drive, and curve (c) displays the brightness variation of the pixel without over drive. If there are 2(m+n), i.e. N=2(m+n), gate lines in the liquid crystal display, the period of the predetermined voltage of over drive for the thin film transistor connected with the first gate line is set as the over exciting period $t_1$, and the period of the data voltage of the present frame interval for the thin film transistor connected with the first gate line is set as the brightness keeping period $t_2$.

When the over exciting period $t_1$ begins, the first gate line $G_1$ and the $2n^{th}$ gate line $G_{2n}$ are simultaneously turned on, and the predetermined voltage code 200 of over drive for the frame is given to the thin film transistor connected to the first gate line $G_1$, the data voltage code 32 of the preceding frame is given to the thin film transistor Q connected to the $2n^{th}$ gate line $G_{2n}$ in other words, the gate driver gives the control voltage pulse to the first gate line $G_1$ and the $2n^{th}$ gate line $G_{2n}$ at the same time, the data driver gives the predetermined voltage code 200 to the thin film transistor Q connected to the first gate line $G_1$, the data voltage code 32 of the preceding frame is given to the thin film transistor Q connected to the $2n^{th}$ gate line $G_{2n}$.

In the same manner, the second and the $(2n+1)^{th}$ gate lines, the third and the $(2n+2)^{th}$ gate lines . . . the $(2m-1)^{th}$ and the $[2(n+m)-2]^{th}$ gate lines are turned on in order, and the predetermined voltage code 200 of over drive for the frame is given to the thin film transistors Q connected to the second to the $(2m-1)^{th}$ gate lines, the data voltage code 32 of the preceding frame is given to the thin film transistors Q connected to the $(2n+1)^{th}$ to the $[2(m+n)-2]^{th}$ gate lines.

When the brightness keeping period $t_2$ begins, the $2m^{th}$ and the first gate lines $G_{2m}$, $G_1$ are simultaneously turned on, and the predetermined voltage code 200 is given to the thin film transistor Q connected to the $2m^{th}$ gate line $G_{2m}$, the data voltage code 120 of the present frame interval is given to the thin film transistor Q connected to the first gate line $G_1$. In the same manner, the $(2m+1)^{th}$ and the second gate lines, the $(2m+2)^{th}$ and the third gate lines . . . the $[2(m+n)]^{th}$ (the last) and the $(2n-1)^{th}$ gate lines are turned on in order, and the predetermined voltage code 200 is given to the thin film transistors Q connected to the $(2m+1)^{th}$ to the $[2(m+n)]^{th}$ (the last) gate lines, the data voltage code 120 is given to the thin film transistors connected to the second to the $(2n-1)^{th}$ gate lines by the steps stated above, the response speed of the liquid crystal display can be increased. If the ratio of the number of the gate lines which were scanned in the over exciting period $t_1$ to the number of the total gate lines is P and the period of the frame interval of the liquid crystal display is T, then the duration of the over exciting is PT and the duration of the brightness keeping is (1-P)T. The ratio P can be adjusted according the characteristic of the display panel.

The Second Embodiment

Figure 8A:
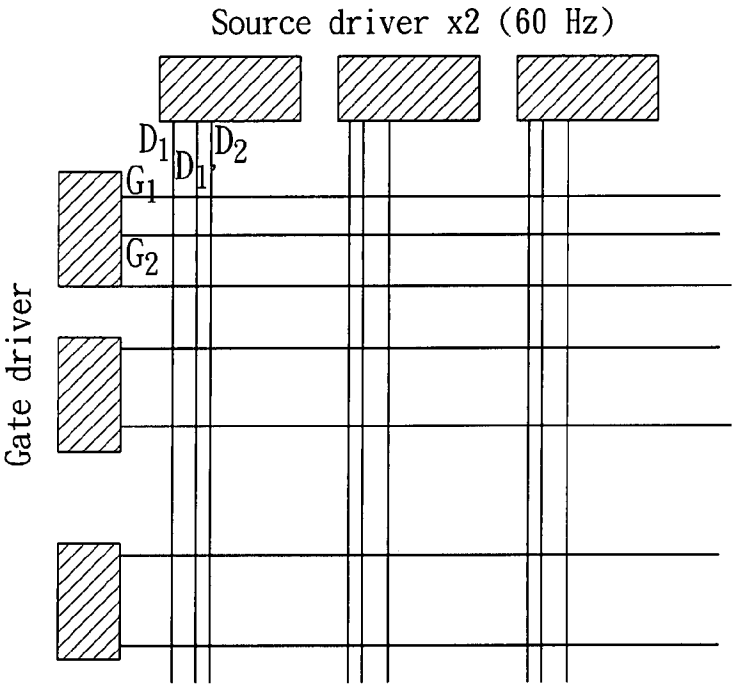
FIG. 8A is a schematic view of the arrangement of the gate lines and the data lines of the display panel of the second embodiment according to the present invention.
Figure 8B:
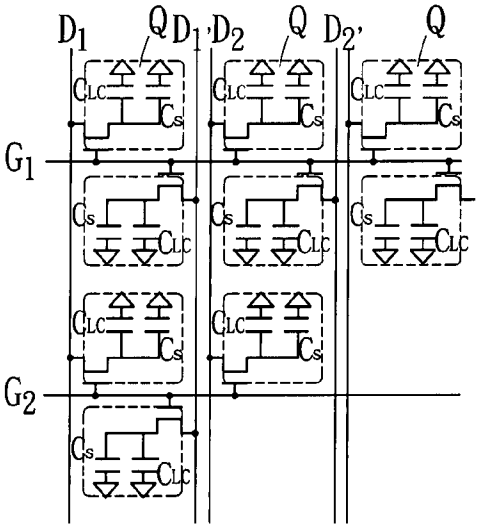
FIG. 8B is an enlarged schematic sectional view taken from FIG. 8A, which shows the arrangement of the gate liens and the data lines and the state of the gate and the source, which are connected with the gate lines and the data lines, of each thin film transistor.
Figure 8C:
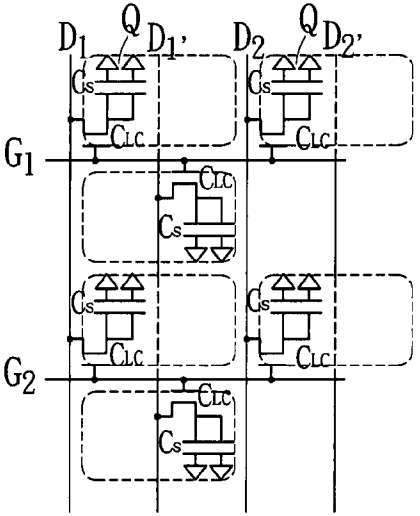
FIG. 8C is an enlarged schematic sectional view taken from FIG. 8A, which shows there is a space between the neighboring data lines for preventing them from short circuit.

Referring to FIG. 8A to 8C, the second embodiment of the liquid crystal display driving device of matrix structure type according to the present invention includes a group of thin film transistors with matrix array, which consist of 2N rows and M columns of thin film transistors Q, wherein, each thin film transistor Q can drive one pixel so that 2N×M of pixels (shown by the rectangle with dotted line) can be driven. The first gate line $G_1$ is connected with the gates of all the thin film transistors Q of the first and the second rows, the second gate line $G_2$ is connected with the gates of all the thin film transistors Q of the third and the fourth rows, and so are the others. Therefore, total N gate lines connected to the gate drivers and insulated with each other.

The first and the second data lines $D_1$, $D_{1'}$ of the first group of data lines are respectively connected with the sources of all the thin film transistors of the odd rows and the even rows of the first column, the first and the second data lines $D_2$, $D_{2'}$ of the second group of data lines are respectively connected with the sources of all the thin film transistors of the odd and the even rows of the second column and so are the others. Therefore, in total there are M groups of data lines connected to the data drivers and they are insulated with each other. To prevent the neighboring data lines from short circuit, for example, the second data line $D_{1'}$ of the first group of data lines and the first data line $D_2$ of the second group of data lines, there is a space between the neighboring data lines, of which arrangement is shown in FIG. 8C. By this design, the aspect ratio of the liquid crystal display can be increased.

Figure 9A:
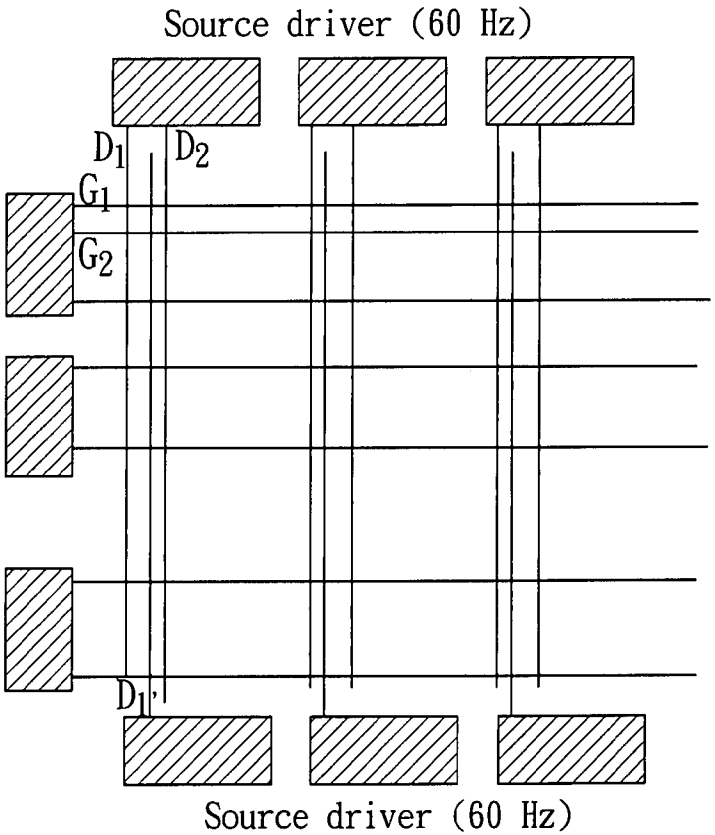
FIG. 9A is a schematic view of the arrangement of the gate lines and the data lines of the display panel of the second embodiment according to the present invention, which shows the state of the data drivers respectively installed on the upper side and the lower side of the display panel.
Figure 9B:
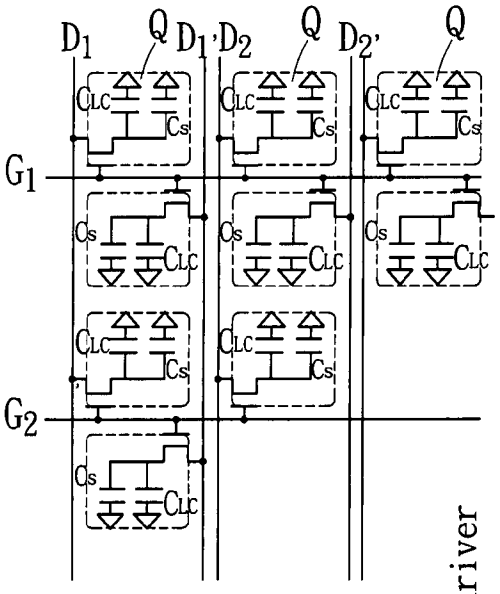
FIG. 9B is an enlarged schematic sectional view taken from FIG. 9A, which shows the arrangement of the gate lines and the data lines and the state of the gate and the source, which are connected with the gate lines and the data lines, of each thin film transistor.
Figure 10A:
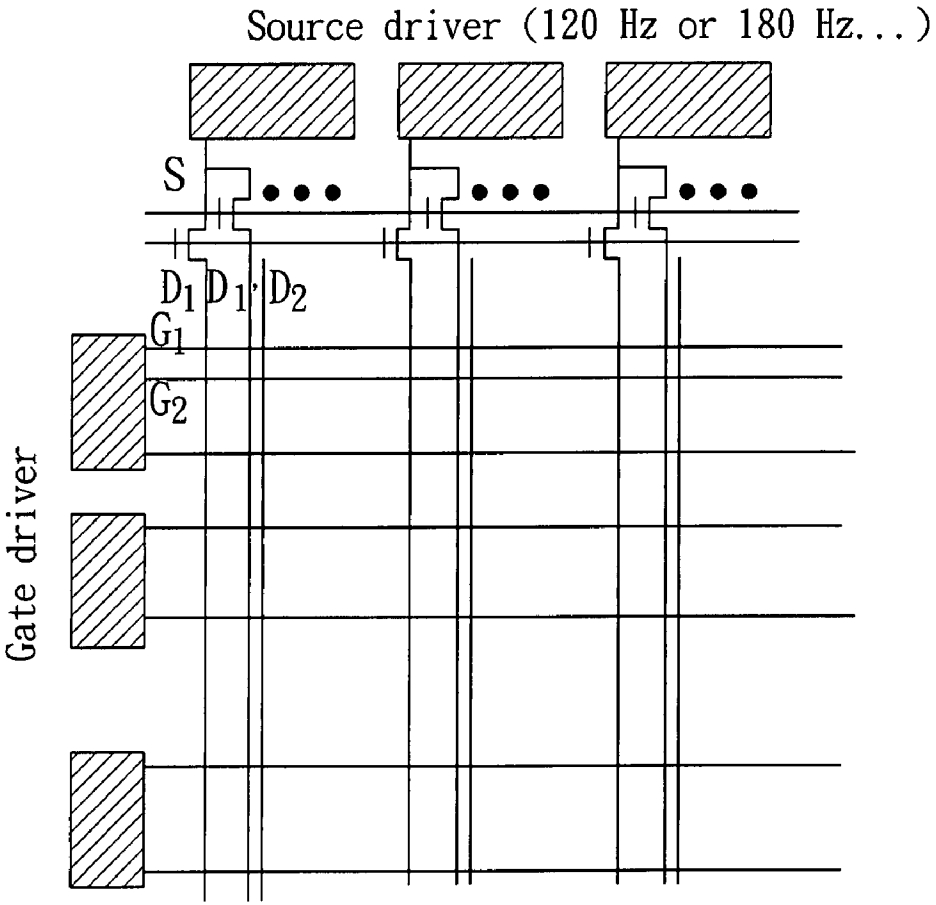
FIG. 10A is a schematic view of the arrangement of the gate lines and the data lines of the display panel of the second embodiment according to the present invention, which shows the state of each pair of data lines connected to a data driver, which is connected to the electronic switch.
Figure 10B:
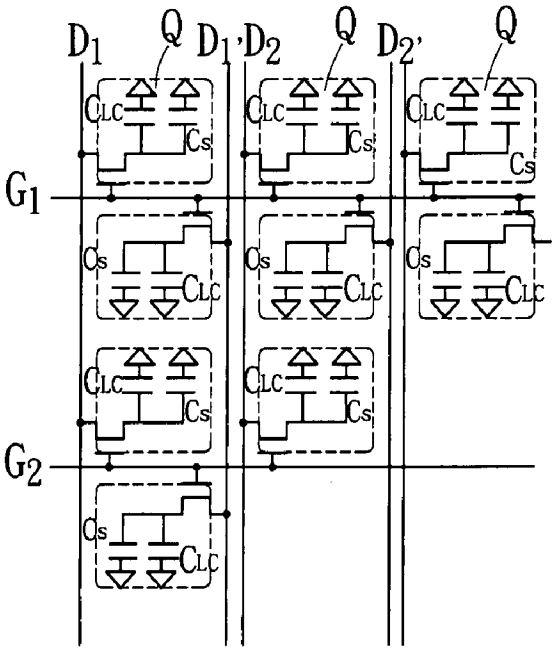
FIG. 10B is an enlarged schematic sectional view taken from FIG. 10A, which shows the arrangement of the gate lines and the data lines and the state of the gate and the source, which are connected to the gate lines and the data lines, of each thin film transistor.

Referring to FIG. 8A, the data drivers connected with the data lines are installed on the same side of the display panel. If the scanning frequency is 60 Hz and two gate lines are simultaneously turned on, the scanning time can be further reduced. The arrangement of the data drivers is shown as FIGS. 9A and 9B. The first and the second data lines of each group of data lines are respectively connected with the data drivers installed on the upper and the lower sides of the liquid crystal display, wherein the scanning frequency of the data drivers is kept at 60 Hz. As shown in FIGS. 10A and 10B, the first data line of each group of data lines and the neighboring second line of another group of data lines are connected with the same drivers, and the data transfer is switched by an electronic switch, of which scanning frequency is a multiple of 60 Hz, such as 120 Hz, 180 Hz . . . etc. The form of the gate driver can be a chip on glass or an integrated gate driver circuit on glass.

Figure 11:
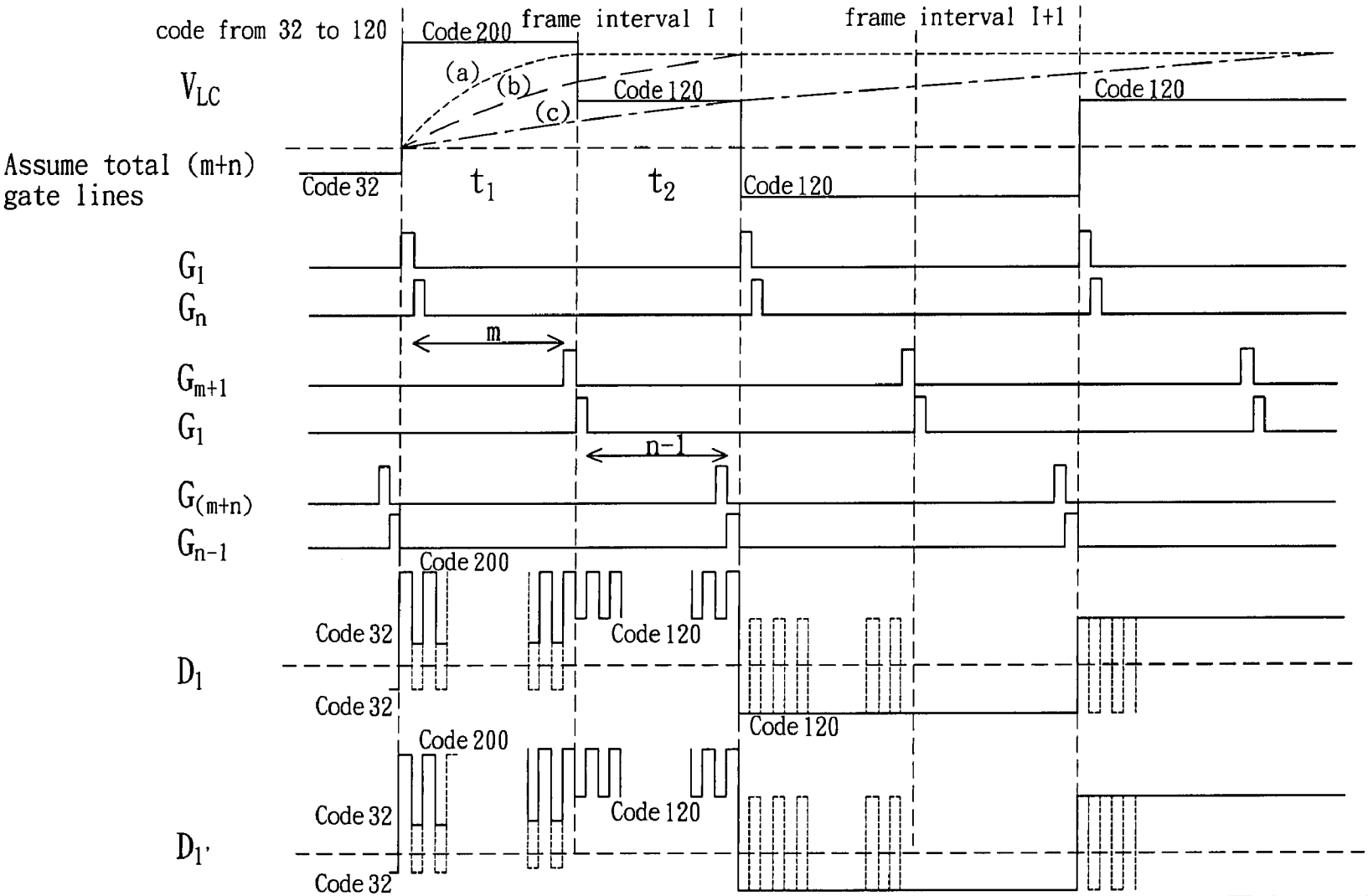
FIG. 11 is a wave form view of the signal used in the driving method of the display device of the second embodiment according to the present invention, which shows the variation of the wave form of the signal of the gate lines and the data lines from the gate driver and the data driver ate different frame interval time.

Referring to FIG. 11, in the driving method of the present invention executed by the said device, when time is at frame interval 1, the expected brightness is code 120 and $V_{LC}$ is the driving voltage pulse. To prevent the driving voltage pulse from confusing with the alternating voltage for driving liquid crystal, the value of the driving voltage pulse will be expressed with code in the following statement. In FIG. 11, curve (a) represents the brightness variation of the pixel in response to 5 milliseconds of over drive, curve (b) shows the brightness variation of the pixel in response to 16 milliseconds of over drive, and curve (c) displays the brightness variation of the pixel without over drive.

If there are m+n, i.e. N=m+n, gate lines in liquid crystal display, the period of the predetermined voltage of over drive for the thin film transistor connected with the first gate line is set as the over exciting period $t_1$, and the period of the data voltage of the present frame interval for the thin film transistor connected with the first gate line is set as the brightness keeping period $t_2$.

When the over exciting period $t_1$ begins, the first and the $n^{th}$ gate lines $G_1$, $G_n$ are orderly turned on in a synchronous control time. The predetermined voltage code 200 of over drive of the frame and the data voltage code 32 of the preceding frame are respectively given to the thin film transistors Q connected with the first and the $n^{th}$ gate lines.

In the same manner, the second and the (n+1)th gate lines, the third and the $(n+2)^{th}$ gate lines . . . and the $m^{th}$ and the $(m+n-1)^{th}$ gate lines are turned on, and the predetermined voltage code 200 is given to the thin film transistors Q connected with the second to $m^{th}$ gate lines, the data voltage code 32 of the preceding frame is given to the thin film transistors Q connected with the $(n+1)^{th}$ to $(m+n-1)^{th}$ gate lines.

When the brightness keeping period $t_2$ begins, the $(m+1)^{th}$ and the first gate lines $G_{m+1}$, $G_1$ are orderly turned on in a synchronous control time. The predetermined voltage code 200 and the data voltage code 120 of the present frame interval are respectively given to the thin film transistors Q connected with the $(m+1)^{th}$ and the first gate lines $G_{m+1}$, $G_1$. The $(m+2)^{th}$ and the second gate lines, the $(m+3)^{th}$ and the third gate lines . . . and the $(m+n)^{th}$ (i.e. the last) and the $(n-1)^{th}$ gate lines $G_{m+n}$, $G_{n-1}$ are orderly and synchronously turned on. The predetermined voltage code 200 is given to the thin film transistors Q connected with the $(m+2)^{th}$ to $(m+n)^{th}$ (i.e. the last) gate lines, and the data voltage code 120 is given to the thin film transistors Q connected with the second to the $(n-1)^{th}$ gate lines. By this way, the object of increasing response speed of the liquid crystal display can be accomplished.

If the ratio of the number of the gate lines scanned in the over exciting period $t_1$ to the number of the total gate lines is P and the period of the frame interval of the liquid crystal display is T, then the duration of the over exciting is PT and the duration of the brightness keeping is (1-P)T. The ratio P can be adjusted according the characteristic of the display panel.

The Third Embodiment

Figures 12A, 12B, 12C:
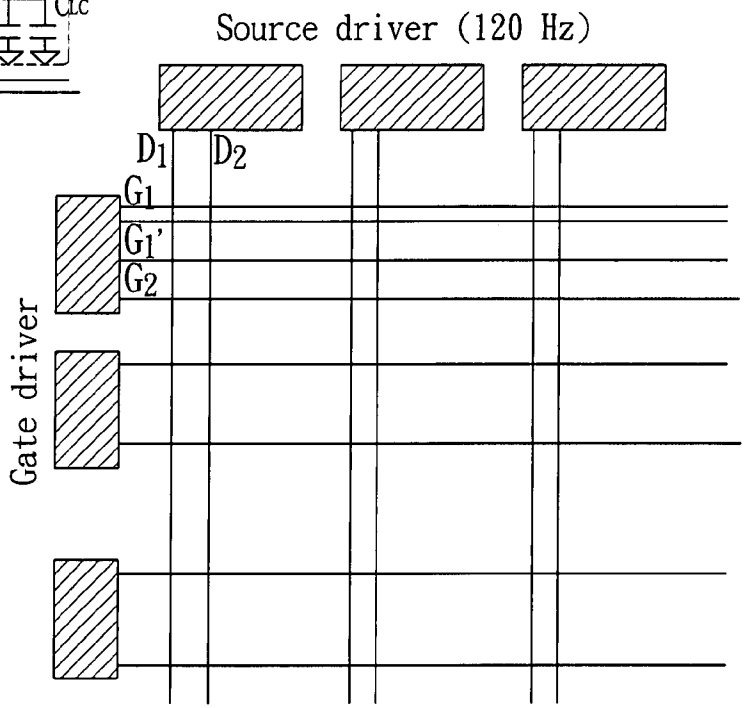
FIG. 12A is a schematic view showing the arrangement of the gate lines and the data lines of the display panel of the third embodiment according to the present invention.
FIG. 12B is an enlarged schematic sectional view taken from FIG. 12A, which shows the arrangement of the gate lines and the data lines and the state of the gate and the source, which are connected to the gate lines and the data lines, of each thin film transistor.
FIG. 12C is an enlarged schematic sectional view taken from FIG. 12A, which shows there is a space between the neighboring gate liens to prevent them from short circuit.

Referring to FIG. 12A to 12C, the third embodiment of the liquid crystal display driving device of matrix structure type according to the present invention includes a group of thin film transistors with matrix array, which consists of N rows and 2M columns of thin film transistors Q, wherein each thin film transistor can drive one pixel, so total N×2M of pixels (shown by the rectangle of dotted line). The first and the second gate lines $G_1$, $G_{1'}$ of the first group of the gate lines are respectively connected with the gates of all the thin film transistors of the odd columns and the even columns of the first row, the first and the second gate lines $G_2$, $G_{2'}$ of the second group of gate lines are respectively connected with the gates of all the transistors Q of the odd columns and the even columns of the second row . . . and the first and the second gate lines of the $N^{th}$ group of gate lines are respectively connected with the gates of all the thin film transistors of the odd columns and the even columns of the $N^{th}$ row, therefore, there are in total N groups of gate lines connected to the gate drivers and insulated with each other. The first data line $D_1$ is connected with the sources of all the thin film transistors Q of the first and the second columns, the second data line $D_2$ is connected with the sources of all the thin film transistors Q of the third and the fourth columns . . . and the $M^{th}$ data line is connected with the sources of all the thin film transistors Q of the $(2M-1)^{th}$ and the $2M^{th}$ columns. Therefore, there are in total M data lines connected with the data drivers and insulated with each other. To prevent the neighboring gate lines from short circuit, for example, the first and the second gate lines $G_1$, $G_{1'}$ of the first group of gate lines, there is a space between the neighboring gate lines, of which arrangement is shown as FIG. 12C. By the arrangement of the device stated above, the number of the data lines and the data drivers can be reduced.

Figure 13A:
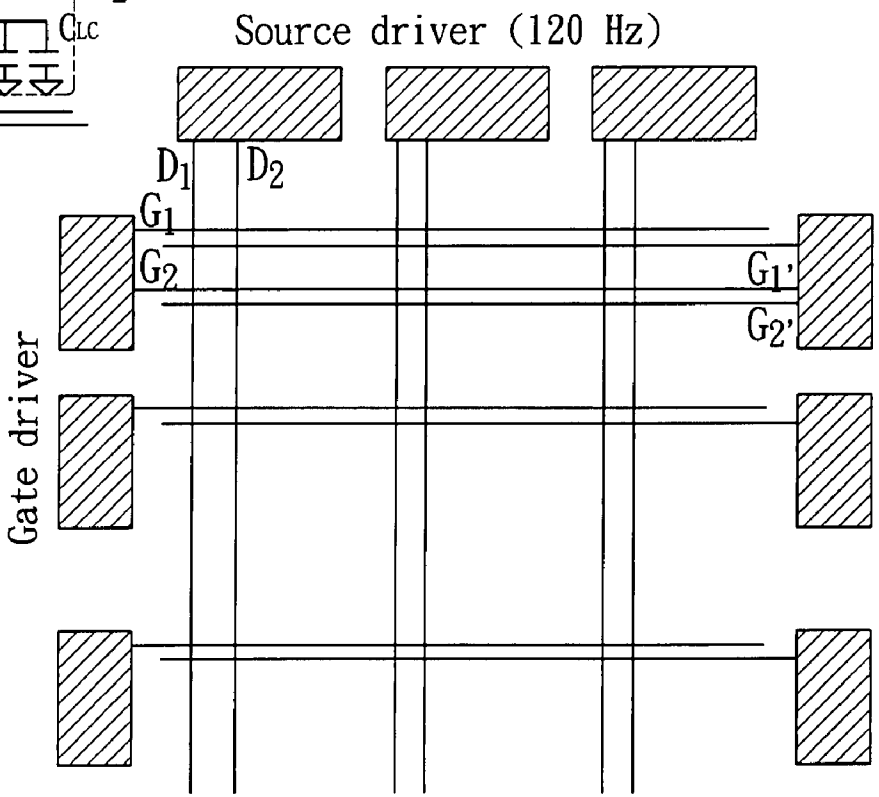
FIG. 13A is a schematic view of the arrangement of the gate lines and the data lines of the display panel of the third embodiment according to the present invention, which shows the state of the gate drivers respectively installed on the left side and the right side of the display panel.
Figure 13B:
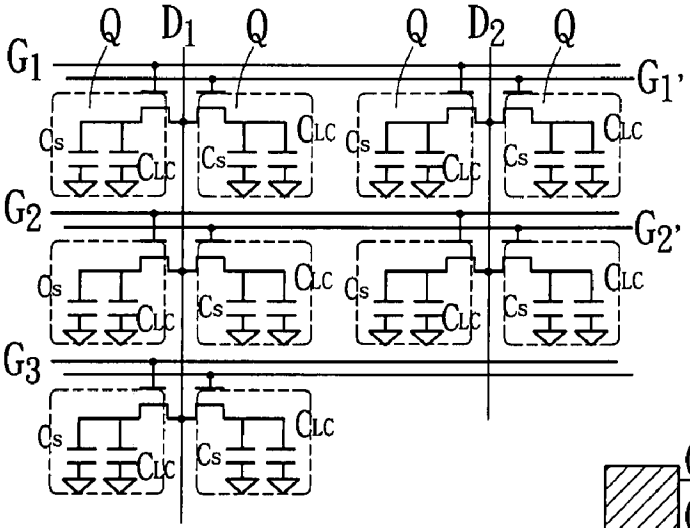
FIG. 13B is an enlarged schematic sectional view taken from FIG. 13A, which shows the arrangement of the gate lines and the data lines and the state of the gate and the source, which are connected to the gate lines and the data lines, of each thin film transistor.

Referring to FIG. 12A, the gate drivers connected with the gate lines are installed on the same side of the display panel. Referring to FIGS. 13A and 13B, the first and the second gate lines of each group of gate lines are respectively given data by two groups of gate drivers, and the two groups of gate drivers are respectively installed on the left side and the right side of the liquid crystal display. The form of the gate driver can be a chip on glass, or an integrated gate driver circuit on glass.

Figure 14:
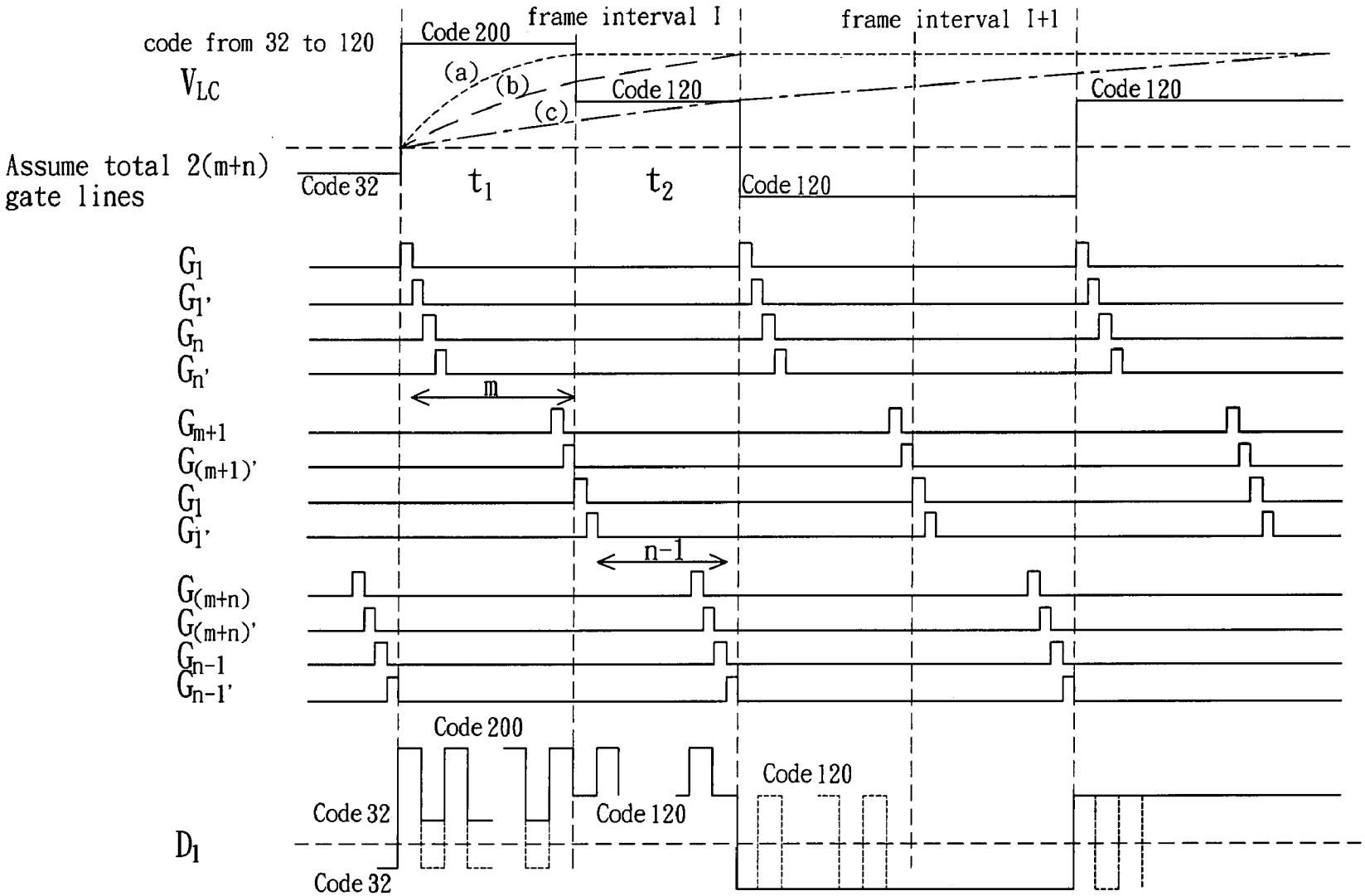
FIG. 14 is a wave form view of the signal used in the driving method of the display device of the third embodiment according to the present invention, which shows the variation of the wave form of the signal of the gate lines and the data lines from the gate drivers and the data drivers at different frame interval time.

Referring to FIG. 14, in the driving method of the present invention executed by the said device, when time is at frame interval 1, the expected brightness is code 120 and $V_{LC}$ is the driving voltage pulse. To prevent the driving voltage pulse from confusing with the alternating voltage for driving liquid crystal, the value of the driving voltage pulse is expressed with code. In FIG. 14, curve (a) expresses the brightness variation of the pixel in response of the 5 milliseconds of over drive, curve (b) shows the brightness variation of the pixel in response of the 16 milliseconds of over drive, and curve (c) displays the brightness variation of the pixel without no over drive.

If there are 2(m+n), i.e. N=2(m+n), gate lines in the liquid crystal display, the period of the predetermined voltage of over drive for the thin film transistor connected with the first gate line of the first group of gate lines is set as the over exciting period $t_1$, and the period of the data voltage of the present frame interval received by the thin film transistor connected to the first gate line of the first group of gate lines is set as the brightness keeping period $t_2$.

When the over exciting period $t_1$ begins, the first and the second gate line $G_1$, $G_{1'}$ of the first group of gate lines are orderly turned on in a time of one synchronous control signal. The predetermined voltage code 200 of over drive of the frame is given to the thin film transistors Q connected with the first and the second gate lines of the first group of gate lines, and the first and the second gate lines $G_n$, $G_{n'}$ of the $n^{th}$ group of gate lines are orderly turned on by the synchronous control signal. The data voltage code 32 of the preceding frame is given to the thin film transistor Q connected with the first and the second gate lines $G_n$, $G_{n'}$ of the $n^{th}$ group of gate lines.

In the same manner, the first and the second gate lines of the second group of gate lines, the first and the second gate lines of the $(n+1)^{th}$ gate lines . . . the first and the second gate lines of the $(m+n-1)^{th}$ group of gate lines, the first and the second gate line $G_{m+1}$, $G_{m+1'}$ of the $(m+1)^{th}$ gate lines are orderly and synchronously turned on. The predetermined voltage code 200 is given to the thin film transistors Q connected with the second to the $(m+1)^{th}$ groups of gate lines. The data voltage code 32 of the preceding frame is given to the thin film transistors Q connected with the $(n+1)^{th}$ to the $(m+n-1)^{th}$ group of gate lines.

When the brightness keeping period $t_2$ begins, in a time of one synchronous control signal the first and the second gate lines of the first group of gate lines are orderly turned on. The data voltage of the present frame interval is given to the thin film transistors connected with the said gate lines. The first and the second gate lines of the $(m+2)^{th}$ group of gate lines are orderly turned on by the synchronous control signal. The predetermined voltage code 200 is given to the thin film transistors Q connected with the said gate lines. The first and the second gate lines of the second group of gate lines, the first and the second gate lines of the $(m+3)^{th}$ group of gate lines . . . the first and the second (i.e. the last) of the $(m+n)^{th}$ group of gate lines and the first and the second gate lines of the $(n-1)^{th}$ gate lines are orderly and synchronously turned on. The data voltage code 32 of the present frame interval is given to the thin film transistors connected with the second to the $(n-1)^{th}$ gate lines. The predetermined voltage code 200 is given to the thin film transistors Q connected with the $(m+3)^{th}$ to the $(m+n)^{th}$ gate lines. By use of the steps stated above, the response speed of the liquid crystal display can be increased.

If the ratio of the number of the gate lines scanned in the over exciting period $t_1$ to the number of the total gate lines is P and the period of the frame interval of the liquid crystal display is T, then the over exciting duration is PT and the brightness keeping duration is (1-P)T. The ratio P can be adjusted according to the characteristic of the display panel.

The Fourth Embodiment

Figure 15A:
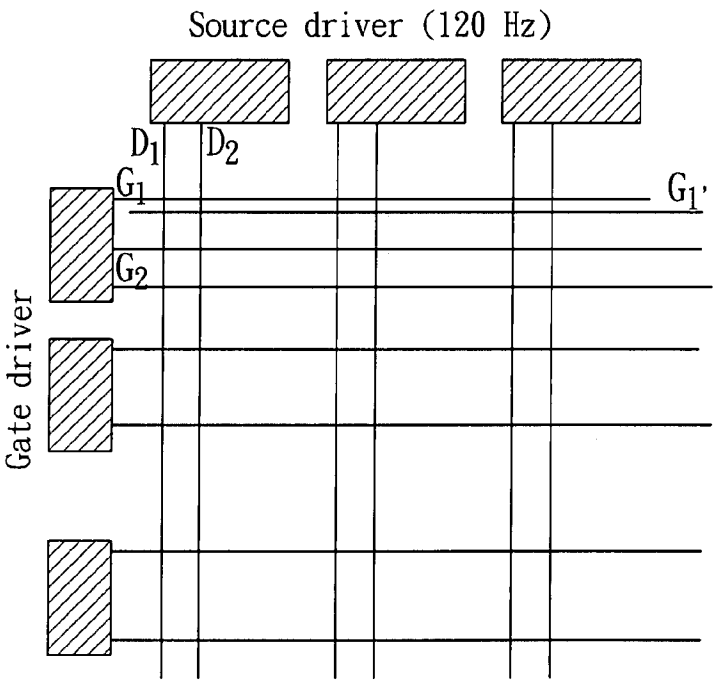
FIG. 15A is a schematic view showing the arrangement of the gate lines and the data lines of the display panel of the fourth embodiment according to the present invention.
Figure 15B:
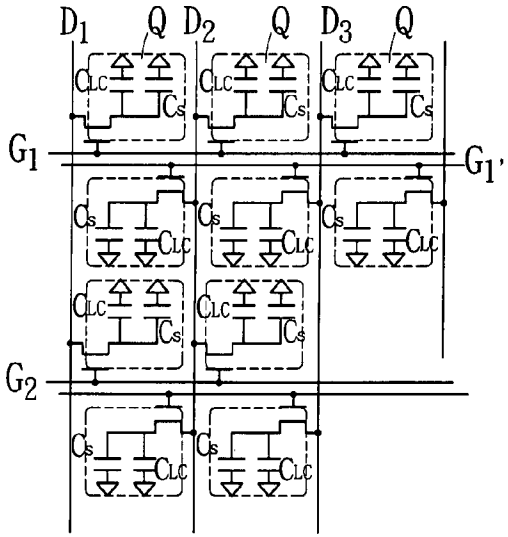
FIG. 15B is an enlarged schematic sectional view taken from FIG. 15A, which shows the arrangement of the gate lines and the data lines and the state of the gate and the source, which are connected to the gate lines and the data lines, of each thin film transistor.

Referring to FIGS. 15A and 15B, the fourth embodiment of the liquid crystal display driving device of matrix structure type according to the present invention includes a group of thin film transistors Q with matrix array, which consists of N rows and M columns of thin film transistors Q, wherein each thin film transistor Q can drive one pixel, so total 2N×M of pixels (shown by the rectangle with dotted line) can be driven. The first gate line $G_1$ of the first group of gate lines is connected with the gates of all the thin film transistors Q of the first row, the second gate line $G_{1'}$ of the first group of gate lines is connected with the gates of all the thin film transistors Q of the second row . . . and the second gate line of the $N^{th}$ group of gate lines is connected with the gates of all the thin film transistors Q of the $2N^{th}$ row, therefore, there are in total N groups of gate lines connected to gate drivers and insulated with each other.

The first and the second data lines $D_1$, $D_2$ are respectively connected with the sources of all the thin film transistors Q of the odd and the even rows of the first column, the second and the third data lines $D_3$, $D_4$ are respectively connected with the sources of all the thin film transistors Q of the odd and the even rows of the second column . . . and the $M^{th}$ and the $(M+1)^{th}$ data lines are respectively connected with the sources of all the thin film transistors Q of the odd and the even rows of the $M^{th}$ column, therefore there are in total M+1 data lines connected to the data drivers and insulated with each other.

Figure 15C:
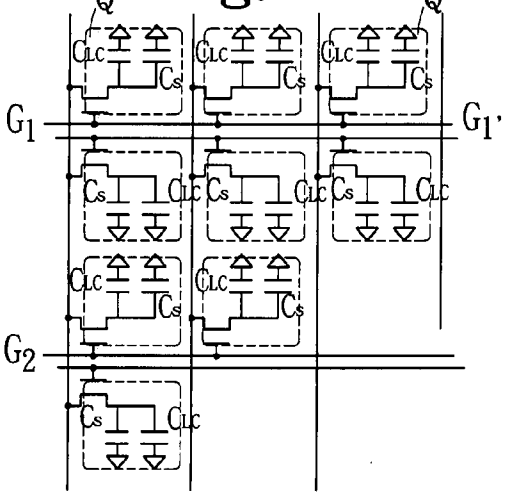
FIG. 15C is an enlarged schematic sectional view taken from FIG. 15A, which shows another arrangement of the gate lines and the data lines of the display panel of the fourth embodiment according to the present invention.

Referring to FIG. 15C, which is the other form of the fourth embodiment. It also consists of 2N rows and M columns of thin film transistors Q, wherein each thin film transistor Q can drive one pixel, so total 2N×M of pixels (shown by rectangle with dotted line) can be driven. The first gate line $G_1$ of the first group of gate lines is connected with the gates of all the thin film transistors Q of the first row, the second gate line $G_2$ of the first group of gate lines is connected with the gates of all the thin film transistors Q of the second row . . . and the second gate line of the $N^{th}$ gate lines is connected with the gates of all the thin film transistors of the $N^{th}$ row, therefore, there are in total N groups of gate lines connected to the gate drivers and insulated with each other. The first data line $D_1$ is connected with the sources of all the thin film transistors Q of the first column, the second data line $D_2$ is connected with the sources of all the thin film transistors Q of the second column . . . and the $M^{th}$ data line is connected with the sources of all the thin film transistors Q of the $M^{th}$ column, therefore, there are in total M data lines connected to the data drivers and insulated with each other.

Figure 16A:
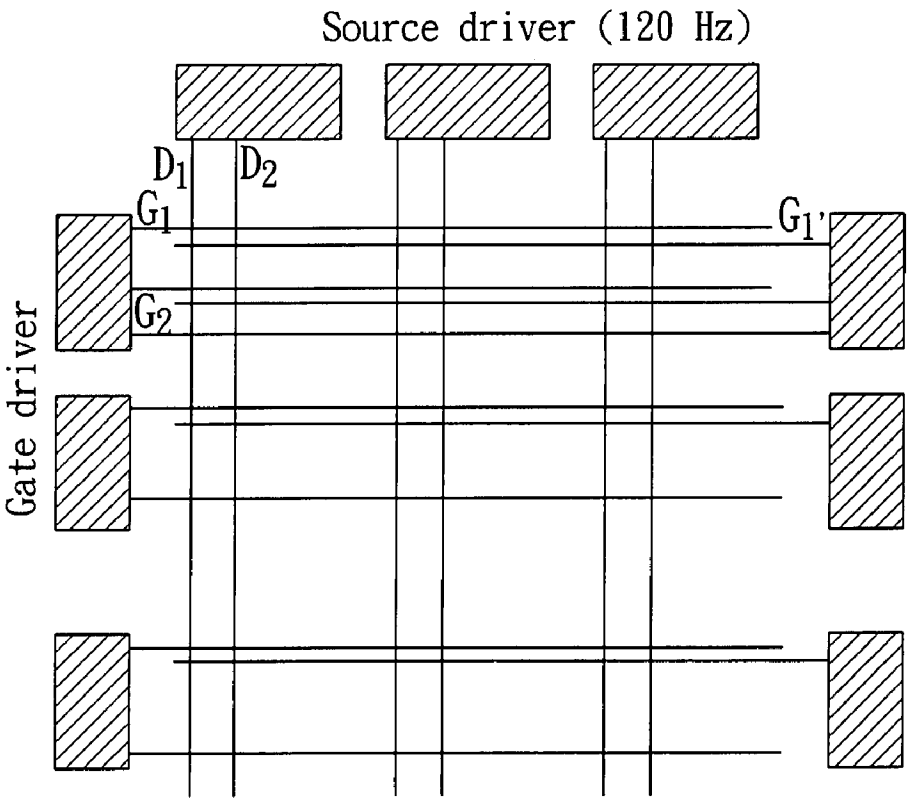
FIG. 16A is a schematic view of the arrangement of the gate lines and the data line of the display panel of the fourth embodiment according to the present invention, which shows the state of the gate drivers respectively installed the left side and the right side of the display panel.
Figure 16B:
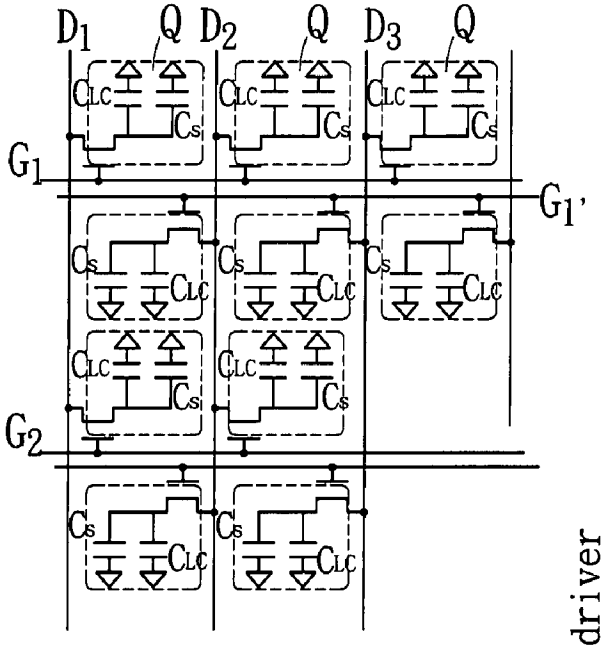
FIG. 16B is an enlarged schematic sectional view taken from FIG. 16A, which shows the arrangement of the gate lines and the data lines and the state of the gate and the source, which are connected to the gate lines and the data lines, of each thin film transistor.

Referring to FIG. 15A, the gate drivers connected with the gate lines are installed on the same side of the display panel. Referring to FIG. 16, the first gate lines and the second gate lines of each group of gate lines are respectively given data by two groups of gate drivers, and the said two groups of gate drivers are respectively installed on the left and the right sides of the liquid crystal display. The form of the gate driver can be a chip on glass, or an integrated gate driver circuit on glass.

Figure 17:
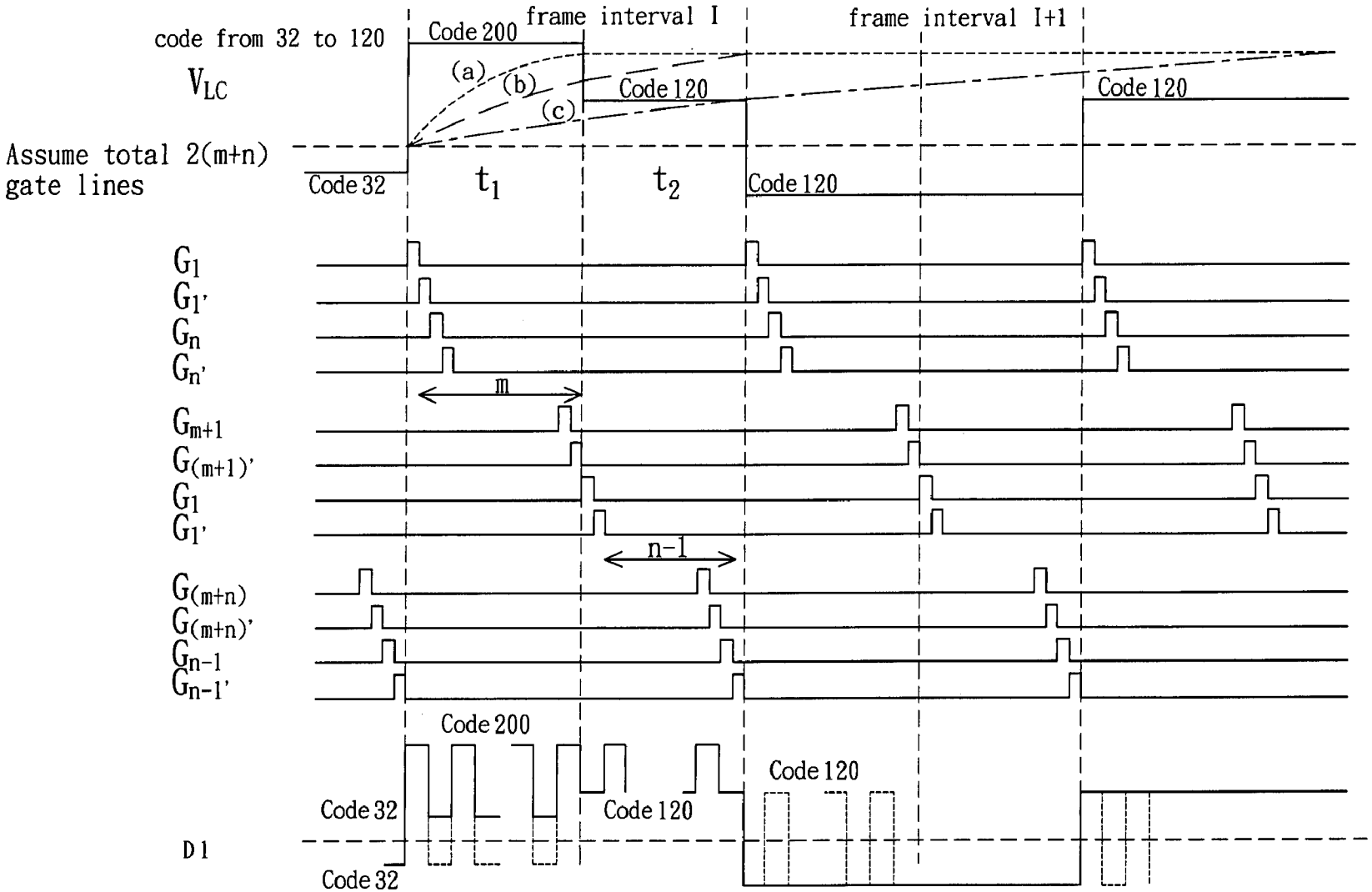
FIG. 17 is a wave form view of the signal used in the driving method of the display device of the fourth embodiment according to the present invention, which shows the variation of the wave form of the signal of the gate lines and the data lines from the gate drivers and the data drivers at different frame interval time.

There are two methods to execute the two forms of the embodiments stated above. Referring to FIG. 17, in the first driving method, when time is at frame interval 1, the expected brightness is code 120 and the $V_{LC}$ is the driving voltage pulse. To prevent the driving voltage from confusing with the alternating voltage for driving liquid crystal, the value of the driving voltage is expressed with code in the following statement. In FIG. 17, curve (a) expresses the brightness variation of the pixel in response of the 5 milliseconds of over drive, curve (b) shows the brightness variation of the pixel in response of the 16 milliseconds of over drive, and curve (c) displays the brightness variation of the pixel without no over drive.

If there are 2(m+n), i.e. N=2(m+n), gate lines in liquid crystal display, the period of the predetermined voltage of over drive for the thin film transistors connected with the first gate line of the first group of gate lines is set as the over exciting period $t_1$, and the period of data voltage of the present frame interval for the thing film transistors connected with the first gate line of the first groups of gate lines is set as the brightness keeping period $t_2$.

When the over exciting period $t_1$ begins, the first and the second gate lines $G_1$, $G_{1'}$ of the first group of gate lines are orderly turned on in a time of one synchronous control signal. The predetermined voltage code 200 of over driver of the frame is given to the thin film transistors Q connected with the first and the second gate lines $G_1$, $G_{1'}$ of the first group of gate lines.

The first and the second gate lines $G_n$, $G_{n'}$ of the $n^{th}$ group of gate lines are orderly turned on by the synchronous control signal. The data voltage code 32 of the preceding frame is given to the thin film transistor Q connected with the said gate lines. The first and the second gate lines of the second group of gate lines, the first and the second gate lines of the $(n+1)^{th}$ group of gate lines . . . the first and the second gate lines of the $(m+n-1)^{th}$ group of gate lines and the first and the second gate lines $G_{m+1}$, $G_{m+1'}$ of the $(m+1)^{th}$ group of gate lines are orderly and simultaneously turned on in a time of synchronous control signal. The predetermined voltage code 200 is given to the thin film transistors Q connected with the second to the $(m+1)^{th}$ groups of gate lines. The data voltage code 32 of the preceding frame is given to the thin film transistors Q connected with the $(n+1)^{th}$ to the $(m+n-1)^{th}$ groups of gate lines.

When the brightness keeping period $t_2$ begins, the first and the second gate lines $G_1$, $G_{1'}$ of the first group of gate are orderly turned on in a time of one synchronous control signal. The data voltage code 120 of the present frame interval is given to the thin film transistors connected with the said gate lines. The first and the second gate lines of the $(m+2)^{th}$ group of gate lines are orderly turned on by the synchronous control signal. The predetermined voltage code 200 is given to the thin film transistors connected with the said gate lines. The first and the second gate lines of the second group of gate lines, the first and the second gate lines of the $(m+3)^{th}$ group of gate lines . . . the first and the second gate lines $G_{m+n}$, $G_{m+n'}$ of the $(m+n)^{th}$ group of gate lines and the first and the second gate lines $G_{n-1}$, $G_{n-1'}$ of the $(n-1)^{th}$ group of gate lines are orderly and synchronously turned on. The predetermined voltage code 200 is given to the thin film transistors Q connected with the $(m+3)^{th}$ to the last gate lines. The data voltage code 120 of the present frame interval is given to the transistors Q connected with the second to the $(n-1)^{th}$ group of gate lines. By use of the steps stated above, the response speed of the liquid crystal display can be increased.

Figure 18:
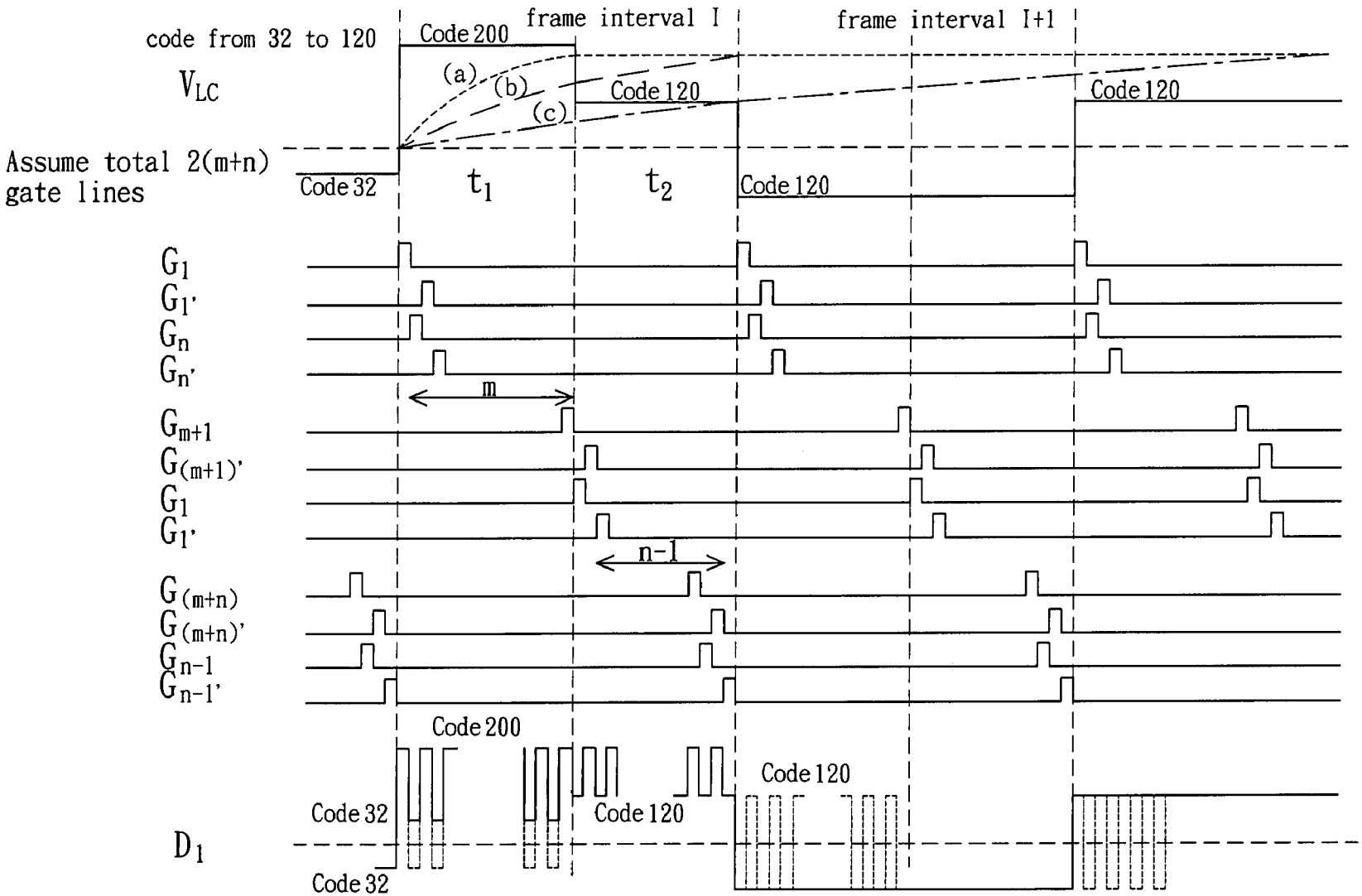
FIG. 18 is a wave form view of the signal used in another driving method of the display device of the third embodiment according to the present invention, which shows the variation of the wave form of the signal of the gate lines and the data lines from the gate drivers and the data drivers at different frame interval time.

Referring to FIG. 18, it shows the second driving method of the present invention. When time is at frame interval 1, the expected brightness is code 120 and $V_{LC}$ is the driving voltage pulse. The voltage value is expressed with code in the following statement to prevent the driving voltage from confusing with the alternating voltage for driving the liquid crystal. In FIG. 18, curve (a) expresses the brightness variation of the pixel in response of the 5 milliseconds of over driver, curve (b) shows the brightness variation of the pixel in response of the 16 milliseconds of over driver, and curve (c) displays the brightness variation of the pixel without over driver. If there are 2m+2n, i.e. N=2m+2n, gate lines in the liquid crystal display, the period of the predetermined voltage of over driver for the thin film transistors connected with the first gate line of the first group of gate lines is set as the over exciting period $t_1$, and the period of the data voltage of the present frame interval for the thin film transistors connected with the first gate line of the first group of gate lines is set as the brightness keeping period $t_2$.

In the over exciting period $t_1$, the first gate line $G_1$ of the first group of gate lines and the first gate line $G_n$ of the $n^{th}$ group of gate lines are orderly turned on in a time of one synchronous control signal. The predetermined voltage code 200 of over driver of one frame and the data voltage code 32 of the preceding frame are respectively given to the thin film transistors Q connected with the said gate lines. Then the second gate line $G_{1'}$ of the first group of gate lines and the second gate line $G_n$ of the $n^{th}$ group of gate lines, the first gate line of the second group of gate lines and the first gate line of the $(n+1)^{th}$ group of gate lines . . . and the second gate line of the $(m+n-1)^{th}$ group of gate lines and the second gate line of the $(m+1)^{th}$ group of gate lines are orderly and synchronously turned on by the synchronous control signal. The predetermined voltage code 200 is given to the thin film transistors Q connected with the first to the $(m+1)^{th}$ groups of gate lines. The data voltage code 32 of the preceding frame is given to the thin film transistors Q connected with the $(n+1)^{th}$ to the $(m+n-1)^{th}$ groups of gate lines.

When the brightness keeping period $t_2$ begins, the first gate line $G_1$ of the first group of gate lines and the first gate line of the $(m+2)^{th}$ group of gate lines are orderly turned on in a time of one synchronous control signal. The data voltage code 120 of the frame interval and the predetermined voltage code 200 are respectively given to the thin film transistors Q connected with the said gate lines. The second gate line $G_{1'}$ of the first group of gate lines and the second gate line of the $(n+2)^{th}$ group of gate lines, the first gate line of the second group of gate lines and the first gate line of the $(m+3)^{th}$ group of gate lines . . . and the second gate line $G_{(n-1)'}$ of the $(n-1)^{th}$ group of gate lines and the second (i.e. the last) gate line $G_{(m+n)'}$ of the $(m+n)^{th}$ group of gate lines are orderly and synchronously turned on. The predetermined voltage code 200 is given to the thin film transistors Q connected with the $(m+2)^{th}$ group to the last gate line $G_{(m+n)'}$. The data voltage code 120 is given to the thin film transistors Q connected with the second group of gate lines to the $(n-1)^{th}$ group of gate lines. By use of the steps stated above, the response speed of the liquid crystal display can be increased.

If the ratio of the number of the gate lines scanned in the over exciting period $t_1$ to the number of the total gate lines is P and the period of the frame interval of the liquid crystal display is T, then the over exciting duration is PT and the brightness keeping duration is (1-P)T. The ratio P can be adjusted according to the characteristic of the display panel.

The Fifth Embodiment

Figure 19A:
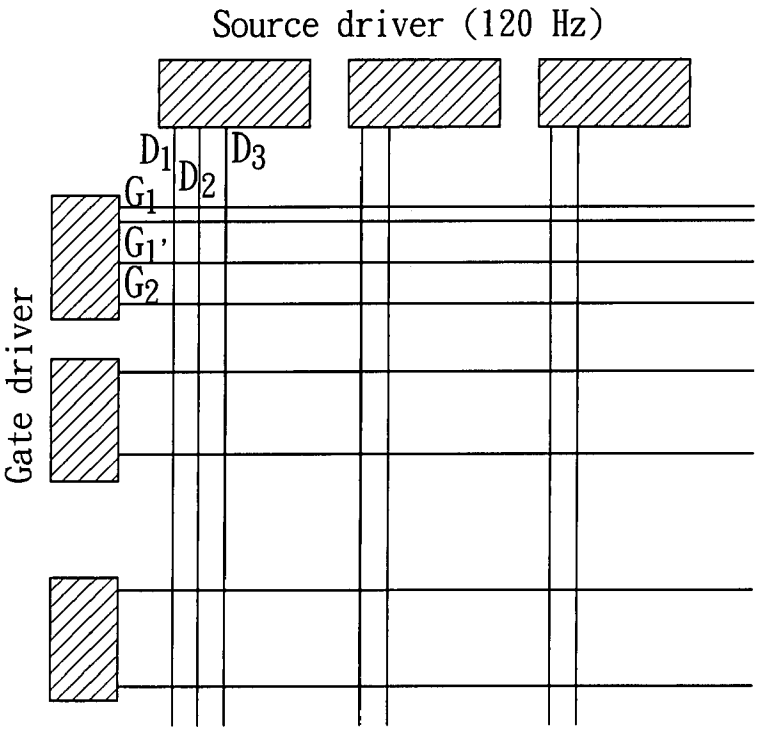
FIG. 19A is a schematic view showing the arrangement of the gate lines and the data lines of the display panel of the fifth embodiment according to the present invention.
Figure 19B:
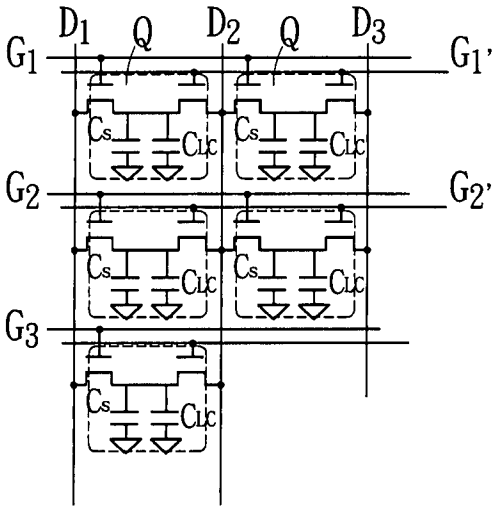
FIG. 19B is an enlarged schematic sectional view taken from FIG. 19A, which shows the arrangement of the gate lines and the data lines and the state of the gate and the source, which are connected to the gate lines and the data lines, of each thin film transistor.
Figure 19C:
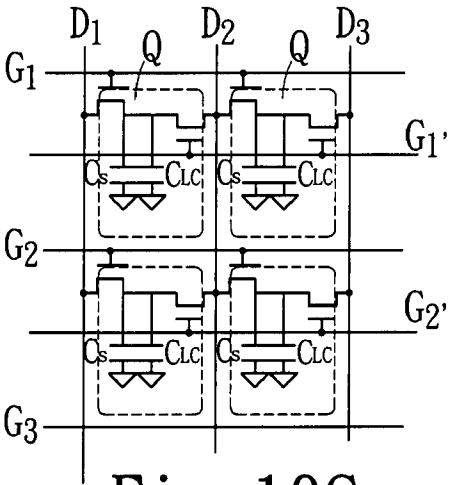
FIG. 19C is an enlarged schematic sectional view taken from FIG. 19A, which shows there is a space between the neighboring gate lines to prevent them from short circuit.

Referring to FIG. 19A to 19C, the fifth embodiment of the liquid crystal display driving device of matrix structure type according to the present invention includes a group of thin film transistors Q with matrix array, which consists of N rows and 2M columns of thin film transistors Q. One pixel is driven by two neighboring thin film transistors Q, therefore total N×M of pixels (shown by rectangle with dotted line) can be driven. The first and the second gate lines $G_1$, $G_{1'}$ of the first group of gate lines are respectively connected with the gates of all the thin film transistors Q of the odd and the even columns of the first row. The first and the second gate lines $G_2$, $G_{2'}$ of the second group of gate lines are respectively connected with the gates of all the thin film transistors Q of the odd and the even columns of the second row . . . and the first and the second gate lines of the $N^{th}$ group of gate lines are respectively connected with the gates of all the thin film transistors Q of the odd and the even columns of the $N^{th}$ row. Therefore, there are in total N groups of gate lines connected to the gate drivers and insulated with each other.

The first data line $D_1$ is connected with the sources of all the thin film transistors Q of the first column. The second data line $D_2$ is connected with the sources of all the thin film transistors Q of the second column . . . and the $2M^{th}$ data line is connected with the sources of all the thin film transistors Q of the $2M^{th}$ column. Therefore, there are in total 2M data lines connected to the data drivers and insulated with each other. To prevent the neighboring gate lines from short circuit, for example, the first gate line $G_1$ and the second gate line $G_{1'}$ of the first group of gate lines, there is a space between the two neighboring gate lines, of which arrangement is shown as FIG. 19C.

Figure 20A:
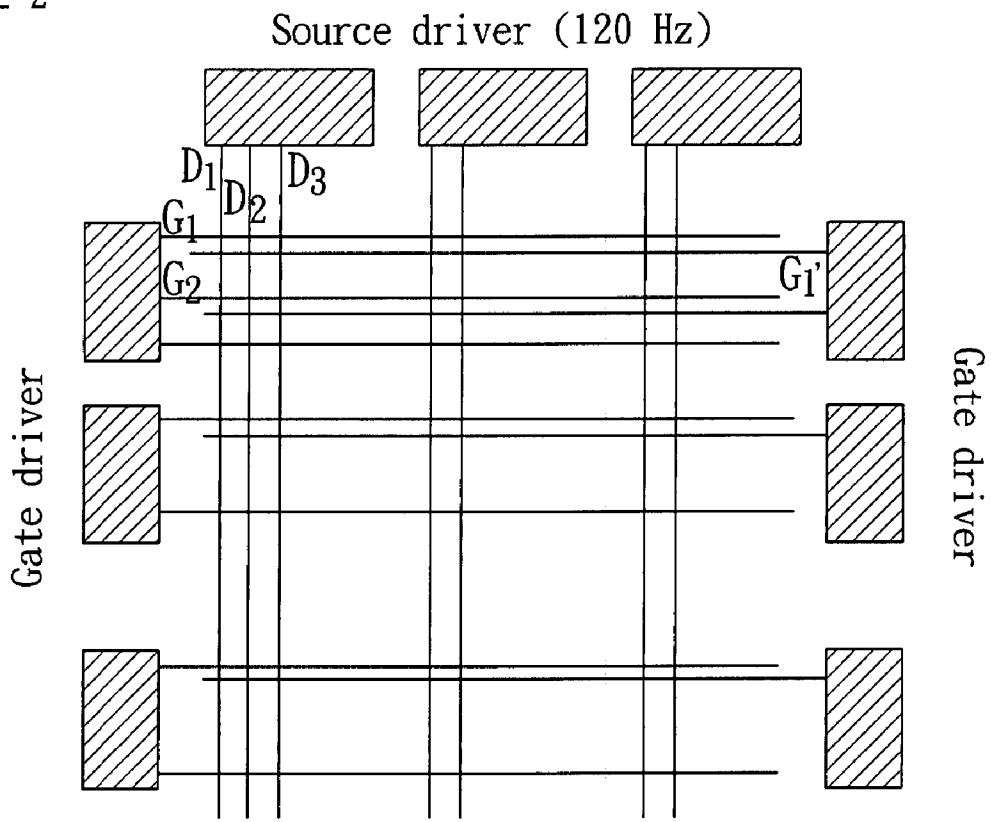
FIG. 20A is a schematic view of the arrangement of the gate lines and the data lines of the display panel of the fifth embodiment according to the present invention, which shows the state of the gate drivers respectively installed on the left side and the right side of the display panel.
Figure 20B:
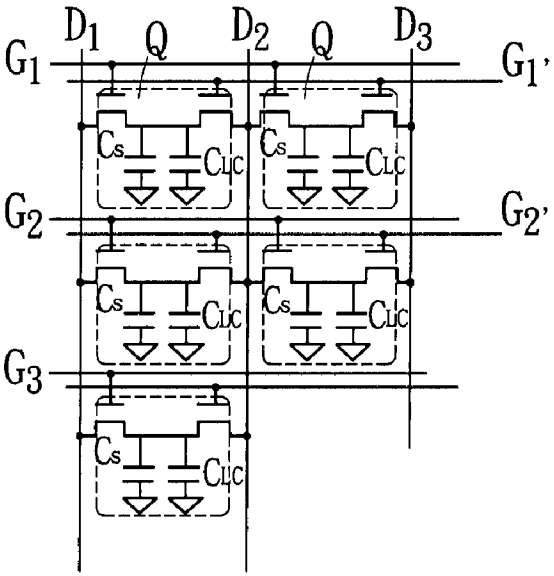
FIG. 20B is an enlarged schematic sectional view taken from FIG. 20A, which shows the arrangement of the gate lines and the data liens and the state of the gate and the source, which are connected to the gate lines and the data lines, of each thin film transistor.

Referring to FIG. 19A, the gate drivers connected with the gate lines are installed on the same side of the display panel. Referring to FIGS. 20A and 20B, the first gate lines and the second gate lines of the each group of gate lines are respectively given data by two groups of gate drivers, and the said two groups of gate drivers are respectively installed on the left and the right sides of the liquid crystal display. The form of the gate driver can be a chip on glass or an integrated gate driver circuit on glass.

Figure 21:
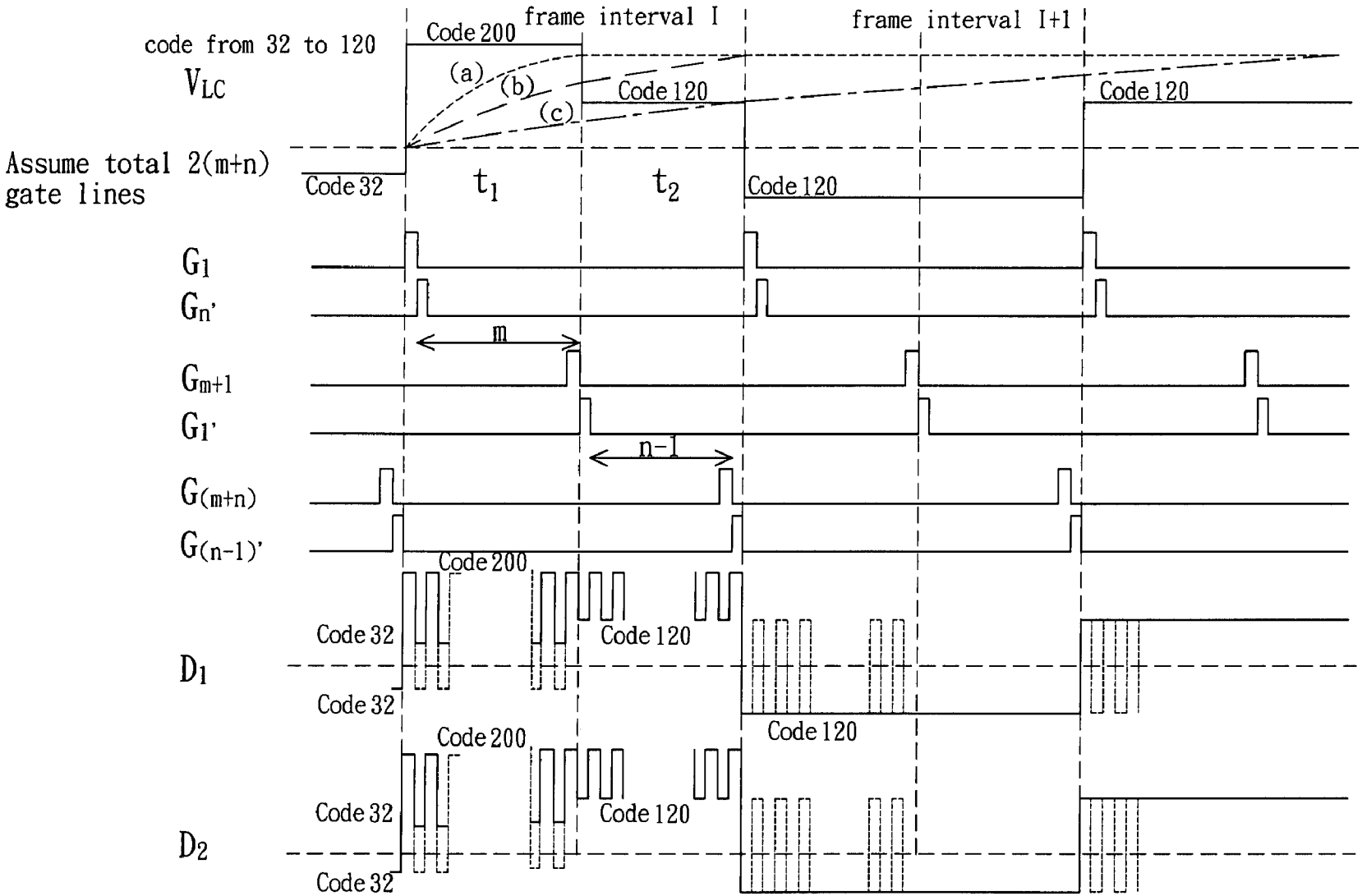
FIG. 21 is a wave form view of the signal used in the driving method of the display device of the fifth embodiment according to the present invention, which shows the variation of the wave form of the signal of the gate lines and the data lines from the gate drivers and the data drivers at different frame interval time.

Referring to FIG. 21, the driving method of the present invention can be executed by the device stated above. When time is at frame interval 1, the expected brightness is code 120 and $V_{LC}$ is the driving voltage pulse. The value of the driving voltage pulse is expressed with code in the following statement to prevent the driving voltage from confusing the alternating voltage for driving liquid crystal. In FIG. 21, curve (a) expresses the brightness variation of the pixel in response of 5 milliseconds of over driver, curve (b) shows the brightness variation of the pixel in response of 16 milliseconds of over driver, and curve (c) displays the brightness variation of the pixel without over driver.

If there are 2m+2n, i.e. N=2m+2n, gate lines in the liquid crystal display, the period of the predetermined voltage of over driver for the thin film transistors connected with the first gate line of the first group of gate lines is set as the over exciting period $t_1$, and the period of the data voltage of the present frame interval for the thin film transistors connected with the second gate line of the first group of gate lines is set as the brightness keeping period $t_2$.

When the over exciting period $t_1$ begins, the first gate line $G_1$ of the first group of gate lines and the second gate line $G_{n'}$ of the $n^{th}$ group of gate lines are orderly turned on in a time of one synchronous control signal. The predetermined voltage code 200 of over driver of the frame and the data voltage code 32 of the preceding frame are respectively given to the thin film transistors Q connected with the said gate lines. The first gate line of the second group of gate lines and the second gate line of the $(n+1)^{th}$ group of gate lines, the first gate line of the third group of gate lines and the second gate line of the $(n+2)^{th}$ group of gate lines . . . and the second gate line of the $(m+n-1)^{th}$ group of gate lines and the first gate line of the $(m+1)^{th}$ group of gate lines are orderly and synchronously turned on in the time of synchronous control signal. The predetermined voltage code 200 is given to the thin film transistors Q connected with the first gate line of the second group to the $(m+1)^{th}$ group of gate lines. The data voltage code 32 of the preceding frame is given to the thin film transistors Q connected with the second gate line of the $(n+1)^{th}$ group to the $(m+n-1)^{th}$ group of gate lines.

When the brightness keeping period $t_2$ begins, the second gate line $G_{1'}$ of the first group of gate lines and the first gate line of the $(m+2)^{th}$ group of gate lines are orderly turned on in a time of one synchronous control signal. The data voltage code 120 of the frame interval and the predetermined voltage code 200 are respectively given to the thin film transistors Q connected with the said gate lines. The first gate line of the $(m+3)^{th}$ group of gate lines and the second gate line of the second group of gate lines, the first gate line of the $(m+4)^{th}$ group of gate lines and the second gate line of the third group of gate lines . . . and the first gate line of the $(m+n)^{th}$ group of gate lines and the second gate line of the $(n-1)^{th}$ group of gate lines are orderly and synchronously turned on. The data voltage code 120 of the present frame interval is given to the thin film transistors Q connected with the second gate line of the second group to the $(n-1)^{th}$ group of gate lines. The predetermined voltage code 200 is given to the thin film transistors Q connected with the first gate lines of the $(m+3)^{th}$ group to the $(m+n)^{th}$ group of gate lines. By use of the steps stated above, the response speed of the liquid crystal display can be increased.

If the ratio of the number of the gate lines scanned in the over exciting period $t_1$ to the number of the total gate lines is P and the frame interval period of the liquid crystal display is T, then the over exciting duration is PT and the brightness keeping duration is (1-P)T. The ratio P can be adjusted according to the characteristic of the display panel.

The Sixth Embodiment

Figure 22A:
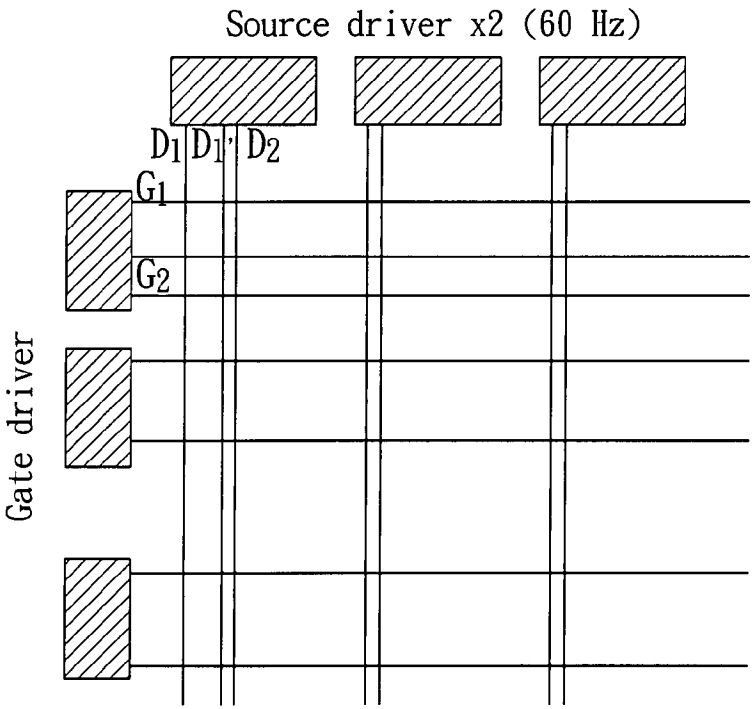
FIG. 22A is a schematic view showing the arrangement of the gate lines and the data lines of the display panel of the sixth embodiment according to the present invention.
Figure 22B:
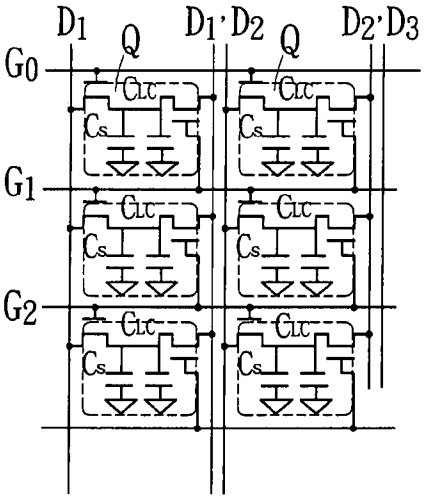
FIG. 22B is an enlarged schematic sectional view taken from FIG. 22A, which shows the arrangement of the gate lines and the data liens and the state of the gate and the source, which are connected to the gate lines and the data lines, of each thin film transistor.
Figure 22C:
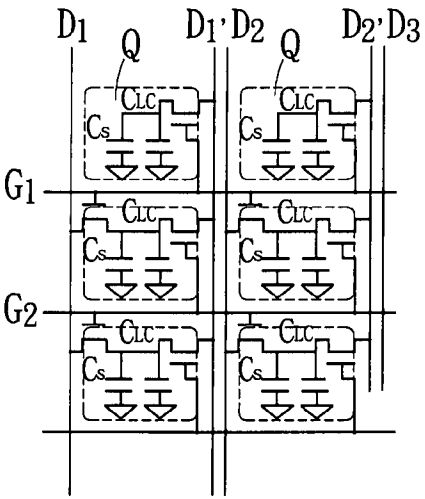
FIG. 22C is an enlarged schematic sectional view taken from FIG. 22A, which shows another arrangement of the gate lines and the data lines and the state of the gate and the source, which are connected to the gate lines and the data lines, of each thin film transistor.

Referring to FIG. 22A to 22C, the sixth embodiment of the liquid crystal display driving device of matrix structure type according to the present invention includes a group of thin film transistors Q with matrix array, which consists of N rows and 2M columns of thin film transistors Q. One pixel is driven by two neighboring thin film transistors so that total N×M of pixels (shown by the rectangle with dotted line) can be driven. The first and the second gate lines $G_1$, $G_2$ are respectively connected with the gates of all the thin film transistors Q of the odd column and the even column of the first row. The second and the third gate lines $G_2$, $G_3$ are respectively connected with gates of all the thin film transistors Q of the odd column and the even column of the second row . . . and the $N^{th}$ and the $(N+1)^{th}$ gate lines are respectively connected with the gates of all the thin film transistors Q of the odd column and the even column of the $N^{th}$ row. Therefore, there are in total N gate lines connected to the gate drivers and insulated with each other.

The first data line $D_1$ of the first group of data lines is connected with the sources of all the thin film transistors Q of the first column. The second data line $D_{1'}$ of the first group of data lines is connected with the sources of all the thin film transistors Q of the second column . . . and the second data line of the $M^{th}$ group of data lines is connected with the sources of all the thin film transistors Q of the $2M^{th}$ column. Therefore, there are in total M groups of data lines connected to the data drivers and insulated with each other.

Figure 22D:
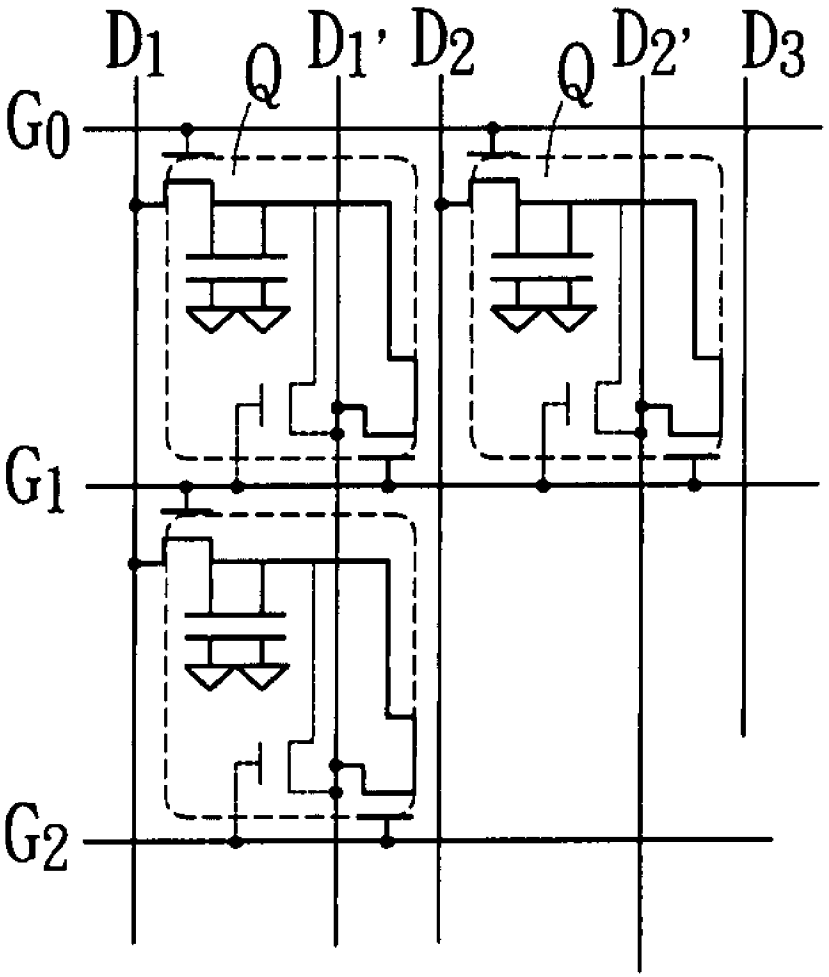
FIG. 22D is an enlarged schematic sectional view taken from FIG. 22A, which shows there is a space between the neighboring data lines for preventing them from short circuit.

Referring to FIG. 22C, a row of thin film transistors Q can be additionally installed above the first row of thin film transistors Q in the present embodiment. Each thin film transistor Q can control a pixel. The gates of the said row of thin film transistors Q are connected with the first gate line and their sources are connected with the second data line of each group of data lines. To prevent the neighboring data lines from short circuit, for example, the second data line $D_{1'}$ of the first group of data lines and the first data line $D_2$ of the second group of data lines, there is a space between two neighboring data lines of which arrangement is shown as FIG. 22D.

Figure 23A:
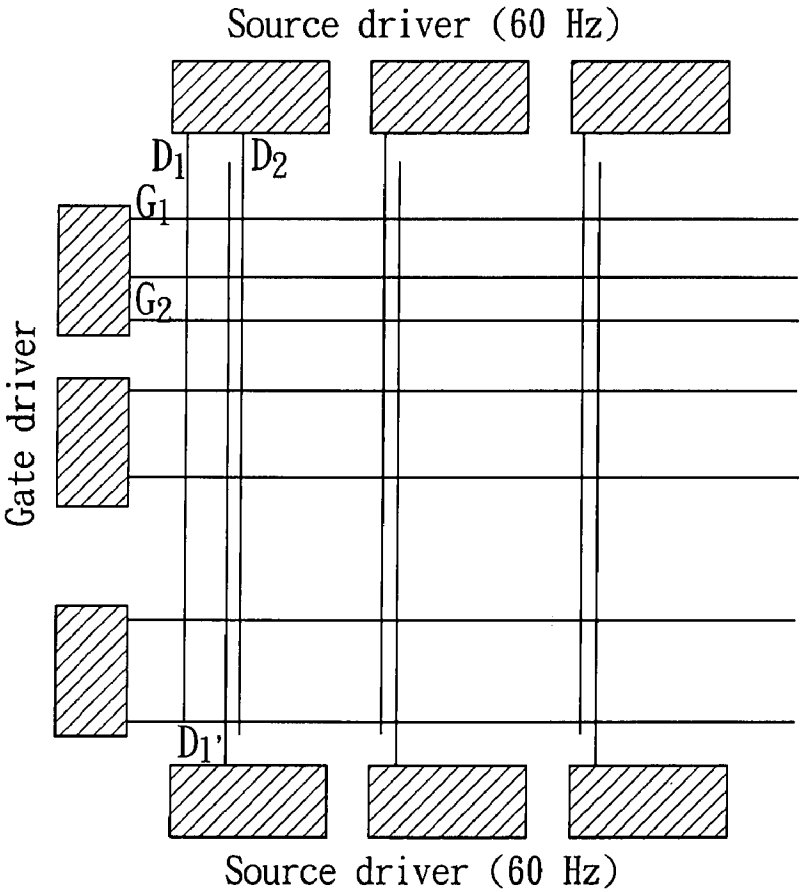
FIG. 23A is a schematic view of the arrangement of the gate lines and the data lines of the display panel of the sixth embodiment according to the present invention, which shows the state of the data drivers respectively installed on the upper side and the lower side of the display panel.
Figure 23B:
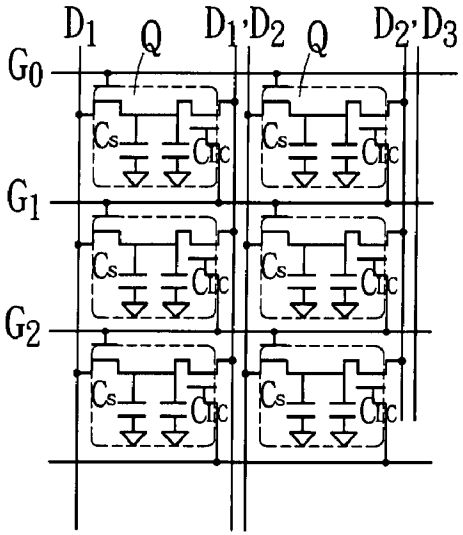
FIG. 23B is an enlarged schematic sectional view taken from FIG. 23A, which shows the arrangement of the gate lines and the data liens and the state of the gate and the source, which are connected to the gate lines and the data lines, of each thin film transistor.
Figure 24A:
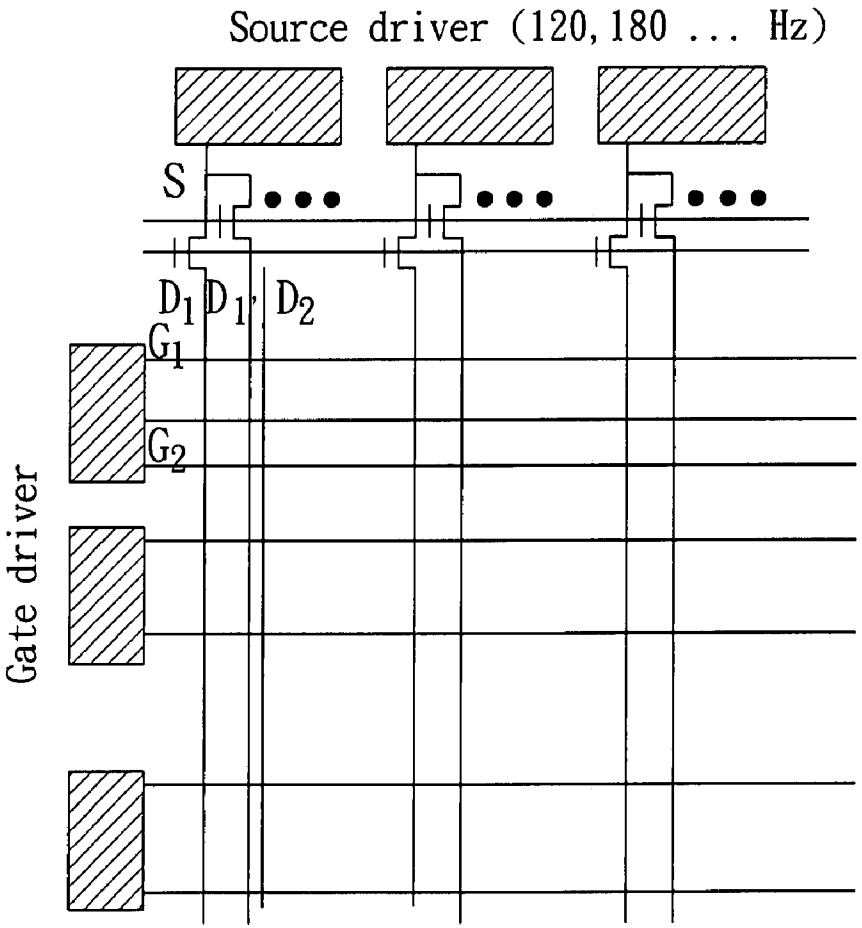
FIG. 24A is a schematic view of the arrangement of the gate lines and the data lines of the display panel of the sixth embodiment according to the present invention, which shows the state of each pair of data lines connected to a data driver, which is connected to the electronic switch.
Figure 24B:
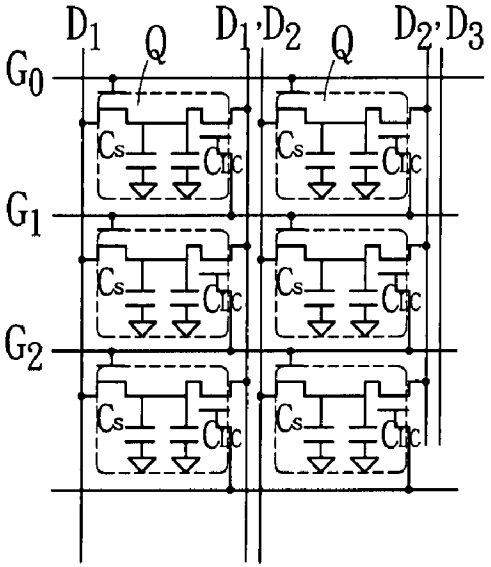
FIG. 24B is an enlarged schematic sectional view taken from FIG. 24A, which shows the arrangement of the gate lines and the data lines and the state of the gate and the source, which are connected to the gate lines and the data lines, of each thin film transistor.

Referring to FIG. 22A, the data drivers connected with the data lines are installed on the same side. If the scanning frequency is 60 Hz and two gate lines are simultaneously turned on, the scanning time can be further decreased. The data drivers can be arranged as shown in FIGS. 23A and 23B. The first data lines and the second data lines of each group of data lines are respectively connected with the data drivers installed on the upper side and the lower side of the liquid crystal display. The scanning frequency of the data drivers is kept at 60 Hz. As shown in FIGS. 24A and 24B, the first data lines and the second data lines of each group of data lines, which are neighboring, are connected with the same data driver. The data transfer is switched by an electronic switch. Its scanning frequency is a multiple of that of the said data driver, for examples, 120 Hz, 180 Hz . . . etc. The form of the gate driver can be a chip on glass, or an integrated gate driver circuit on glass.

Figure 25:
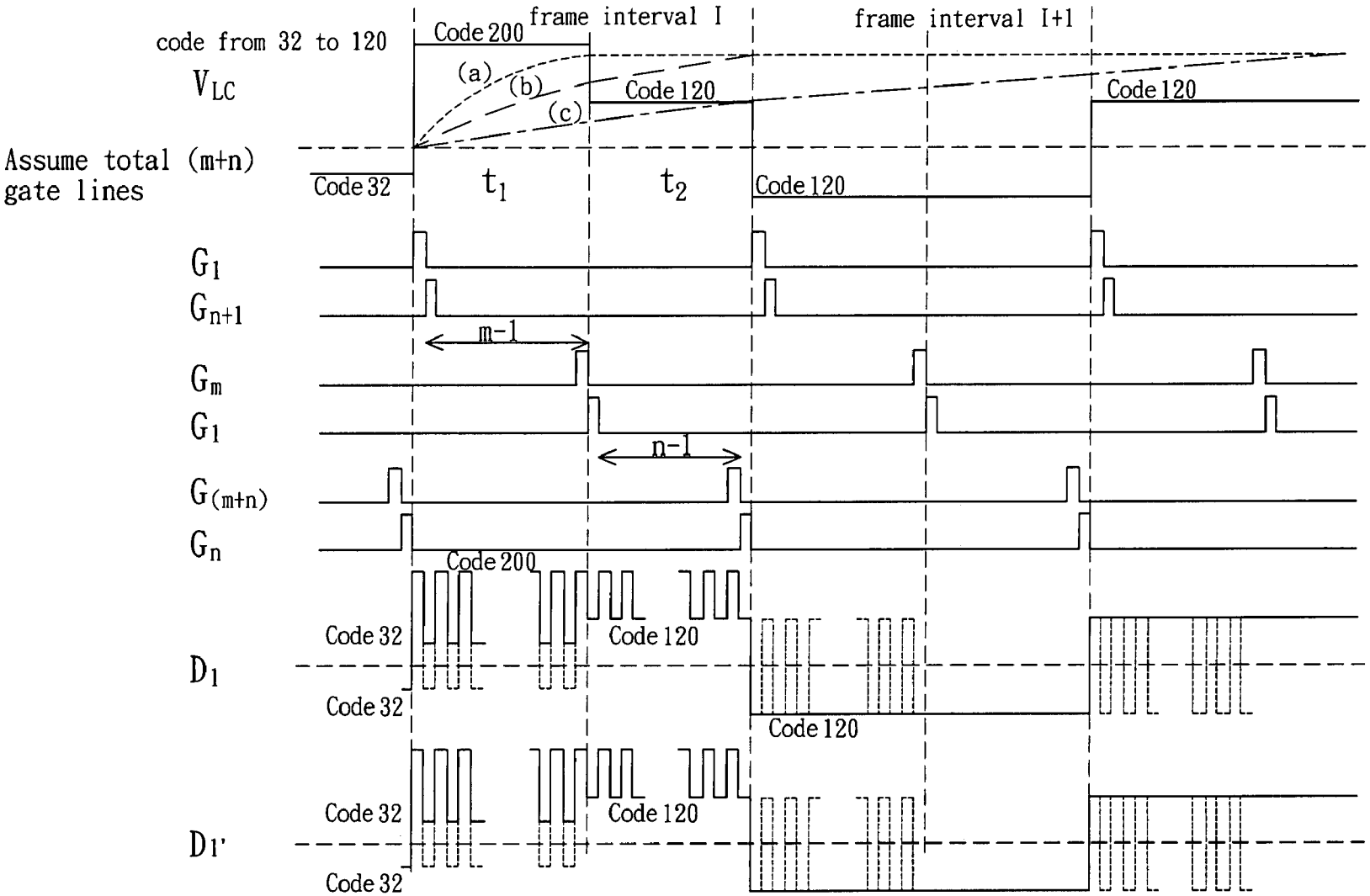
FIG. 25 is a wave form view of the signal used in the driving method of the display device of the sixth embodiment according to the present invention, which shows the variation of the wave form of the signal of the gate lines and the data lines from the gate driver and the data driver ate different frame interval time.

The driving method of the present invention is executed by the device stated above. Referring to FIG. 25, when time is at the frame interval 1, the expected brightness is code 120 and $V_{LC}$ is the driving voltage pulse. The value of the driving voltage is expressed with code in the following statement to prevent the driving voltage from confusing the alternating voltage for driving liquid crystal. In FIG. 25, curve (a) expresses the brightness variation of the pixel in response of the 5 milliseconds of over driver, curve (b) shows the brightness variation of the pixel in response of the 16 milliseconds of over driver. Curve (c) displays the brightness variation of the pixel without over driver.

If there are m+n, i.e. N=m+n, gate lines in the liquid crystal display, the period of the predetermined voltage of over driver for the thin film transistor connected with the first gate line is set as the over exciting period $t_1$ and the period of the data voltage of the present frame interval received by the thin film transistors connected with the first gate line is set as the brightness keeping period $t_2$.

In the over exciting period $t_1$, the first and the $(n+1)^{th}$ gate lines $G_1$, $G_{n+1}$ are orderly turned on in a time of one synchronous control signal. The predetermined voltage code 200 and the data voltage code 32 of the preceding frame are respectively given to the thin film transistors Q connected with the said gate lines. The second and the $(n+2)^{th}$ gate lines, the third and the $(n+3)^{th}$ gate lines . . . and the $(m+n-1)^{th}$ and the $m^{th}$ gate lines are orderly and synchronously turned on in the time of synchronous control signal. The predetermined voltage code 200 is given to the thin film transistors connected with the second to the $m^{th}$ gate lines. The data voltage code 32 of the preceding frame is given to the thin film transistors Q connected with the $(n+2)^{th}$ to the $(m+n-1)^{th}$ gate lines.

During the brightness keeping period $t_2$, the first gate line and the $(m+1)^{th}$ gate line are orderly turned on in a time of one synchronous control signal. The data voltage code 120 of the frame interval and the predetermined voltage code 200 are respectively given to the thin film transistors Q connected with the said gate lines. The second and the $(m+2)^{th}$ gate lines, the third and the $(m+3)^{th}$ gate lines . . . and the $(m+n)^{th}$ (i.e. the last) and the $n^{th}$ gate lines are orderly turned on. The predetermined voltage code 200 is given to the thin film transistors Q connected with the $(m+2)^{th}$ to the $(m+n)^{th}$ (the last) gate lines. The data voltage code 120 is given to the thin film transistors Q connected with the second to the $n^{th}$ gate lines. By use of the steps stated above, the response speed of the liquid crystal display can be increased.

If the number of the gate lines scanned in the over exciting period $t_1$ to the number of the total gate lines is P and the frame interval time of the liquid crystal display is T, then the over exciting duration is PT and the brightness keeping duration is (1-p)T. The ratio P can be adjusted according to the characteristic of the display panel.

The present invention can quickly drive the liquid crystal display and increase the response speed of the image gray level by the division of the time (frame interval time) and space (gate lines) and the application of the predetermined voltage and data voltage in the steps stated above. The driving method according to the present invention can suit for various liquid crystal display, active matrix type liquid crystal display, organic light emitting diode (OLED) display or plasma display panel (PDP).

The "frame in frame" technique of the present invention has been described by the above embodiments, but they cannot be used to limit the present invention. Any persons skilled at the art related to the present invention can make partial modification and variation without departing from the spirit and the scope of the present invention. The patent scope of the present invention should take the accompanying claims as the criterion.

Therefore, the present invention has the following advantages:

1. The liquid crystal display driving device of matrix structure type according to the present invention can increase both the response speed of the liquid crystal panel and the aspect ratio of the panel, but decrease both the number of the data drivers and the data lines and the production cost.
2. The driving method for the liquid crystal display of matrix structure type according to the present invention can simultaneously or synchronously turn on two rows of thin film transistors and the pixel of the panel can be driven by the thin film transistors, so the object of reducing the response time of the liquid crystal display can be accomplished.

To sum up, the present invention indeed can accomplish its expected object of providing a liquid crystal display driving device of matrix structure type and its driving method to increase the response speed. It has high utilization value in industry, so it is brought forward claiming patent right.

What is claimed is:

1. A liquid crystal display driving device of matrix structure type including:

a group of thin film transistors with matrix array consisting of N rows and M columns of thin film transistors, wherein each thin film transistor can drive one pixel so that N×M of pixels can be driven;

a group of N gate lines connected to the gate drivers and insulated with each other, wherein the first gate line is connected with the gates of all the thin film transistors of the first row, the second gate line is connected with the gates of all the thin film transistors of the second row . . . and the $N^{th}$ gate line is connected with the gates of all the thin film transistors of the $N^{th}$ row; and M groups of data lines connected to the source drivers and insulated with each other, wherein the first and the second date lines of the first group of date lines are respectively connected with the sources of all the thin film transistors of the odd and the even rows of the first column, the first and the second data lines of the second group of data lines are respectively connected with the sources of all the thin film transistors of the odd and the even rows of the second column . . . and the first and the second data lines of the $M^{th}$ group of data lines are respectively connected with the sources of the all thin film transistors of the odd and the even rows of the $M^{th}$ column, and the first data lines and the second data lines of each group of data lines are connected with the same source driver.

2. The liquid crystal display device of matrix structure type including:

a group of thin film transistors with matrix array consisting of N rows and M columns of thin film transistors, wherein each thin film transistor can drive one pixel so that N×M of pixels can be driven;

a group of N gate lines connected to the gate drivers and insulated with each other, wherein the first gate line is connected with the gates of all the thin film transistors of the first row, the second gate line is connected with the gates of all the thin film transistors of the second row . . . and the $N^{th}$ gate line is connected with the gates of all the thin film transistors of the $N^{th}$ row; and M groups of data lines connected to the source drivers and insulated with each other, wherein the first and the second date lines of the first group of date lines are respectively connected with the sources of all the thin film transistors of the odd and the even rows of the first column, the first and the second data lines of the second group of data lines are respectively connected with the sources of all the thin film transistors of the odd and the even rows of the second column . . . and the first and the second data lines of the $M^{th}$ group of data lines are respectively connected with the sources of the all thin film transistors of the odd and the even rows of the $M^{th}$ column, wherein the first data lines and the second data lines of each group of data lines are connected with the same source driver, each source driver is installed on the same side of the display panel and the data transfer is switched by an electronic switch.

3. The liquid crystal display driving device of matrix structure type as claimed in claim 2, wherein there is a space between the neighboring data lines to prevent them from short circuit.

4. The liquid crystal display driving device of matrix structure type as claimed in claim 2, wherein the gate driver is a chip installed on glass.

5. The liquid crystal display driving device of matrix structure type as claimed in claim 2, wherein the gate driver is an integrated gate driver circuit installed on glass.

6. A driving method for the liquid crystal display of matrix structure type including:

a. making use of the liquid crystal display driving device as claimed in claim 3, wherein there are 2(m+n), i.e. N=2(m+n), gate lines in the liquid crystal display, the period of the predetermined voltage of over drive received by the thin film transistor connected with the first gate line is set as a over exciting period, and the period of the data voltage of the present frame interval received by the thin film transistor connected with the first gate line is set as a brightness keeping period;

b. when the over exciting period begins, the first gate line and the $2n^{th}$ gate line are simultaneously turned on, the predetermined voltage of the over drive for the frame is given to the thin film transistor connected with the first gate line, the data voltage of the preceding frame is given to the thin film transistor connected with the $2n^{th}$ gate line, and the second and the $(2n+1)^{th}$ gate lines, the third and the $(2n+2)^{th}$ gate lines . . . and the $(2m-1)^{th}$ and the $[2(n+m)-2]^{th}$ gate lines are orderly and simultaneously turned on, the predetermined voltage is given to the thin film transistors connected with the second to the $(2m-1)^{th}$ gate lines, the data voltage of the preceding frame is given to the thin film transistors connected with the $(2n+1)^{th}$ to the $[2(m+n)-2]^{th}$ gate lines;

c. when the brightness keeping period begins, the $2m^{th}$ and the fist gate lines are simultaneously turned on, the predetermined voltage is given to the thin film transistors connected with the $2m^{th}$ gate line, the data voltage of the preceding frame interval is given to the thin film transistors connected with the first gate line, and the $(2m+1)^{th}$ and the second gate lines, the $(2m+2)^{th}$ and the third gate lines . . . and the $[2(m+n)]^{th}$ (the last) and the $(2n-1)^{th}$ gate lines are orderly and simultaneously turned on, the predetermined voltage is given to the thin film transistors connected with the $(2m+1)^{th}$ to the $[2(m+n)]^{th}$ (the last) gate lines, the data voltage of the present frame interval is given to the thin film transistors connected with the second and the $(2n-1)^{th}$ gate lines;

by using of the steps stated above, the response speed of the liquid crystal display can be increased.

7. The driving method for liquid crystal display of matrix structure type as claimed in claim 6, wherein the driving method suits for the active matrix type liquid crystal display, the organic light emitting diode (OLED) display or plasma display panel (PDP).

* * * * *